US006377235B1

(12) United States Patent
Murade et al.

(10) Patent No.: US 6,377,235 B1
(45) Date of Patent: Apr. 23, 2002

(54) DRIVE CIRCUIT FOR ELECTRO-OPTIC APPARATUS, METHOD OF DRIVING THE ELECTRO-OPTIC APPARATUS, ELECTRO-OPTIC APPARATUS, AND ELECTRONIC APPARATUS

(75) Inventors: Masao Murade; Nobuyuki Shimotome, both of Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/355,203

(22) PCT Filed: Mar. 31, 1998

(86) PCT No.: PCT/JP98/01477

§ 371 Date: Sep. 13, 1999

§ 102(e) Date: Sep. 13, 1999

(87) PCT Pub. No.: WO99/28896

PCT Pub. Date: Jun. 10, 1999

(30) Foreign Application Priority Data

Nov. 28, 1997 (JP) ..... 9-329284

(51) Int. Cl.[7] ..... G09G 3/00

(52) U.S. Cl. ..... 345/100; 345/92; 377/69; 377/78

(58) Field of Search ..... 345/87–104, 204–209; 377/54, 64, 69, 71, 73, 74, 76, 77, 81, 78, 79; 349/41–48

(56) References Cited

U.S. PATENT DOCUMENTS

| | | | | |
|---|---|---|---|---|
| 3,696,393 A | * | 10/1972 | McDonald | 345/82 |
| 4,499,459 A | * | 2/1985 | Sasaki et al. | 345/55 |
| 5,138,310 A | * | 8/1992 | Hirane | 340/811 |
| 5,151,689 A | * | 9/1992 | Kabuto et al. | 345/103 |
| 6,049,321 A | * | 4/2000 | Sasaki | 345/99 |
| 6,215,533 B1 | * | 4/2001 | Shigeta et al. | 349/37 |

FOREIGN PATENT DOCUMENTS

| | | |
|---|---|---|
| JP | A-55-41442 | 3/1980 |
| JP | A-2-137886 | 5/1990 |
| JP | A-4-294390 | 10/1992 |
| JP | A-5-210361 | 8/1993 |
| JP | A-8-55493 | 2/1996 |
| JP | A-9-212133 | 8/1997 |

* cited by examiner

*Primary Examiner*—Lun-Yi Lao
(74) *Attorney, Agent, or Firm*—Oliff & Berridge, PLC

(57) ABSTRACT

An active matrix drive type liquid crystal device is equipped with a data line driving circuit (101) composed of a bidirectional shift register which has an odd number of output stages and a scanning line driving circuit (104). composed of a bidirectional shift register which has an odd number of output stages so as to make it possible to horizontally and vertically invert the horizontal scanning direction and the vertical scanning direction easily by using a relatively simple constitution.

7 Claims, 17 Drawing Sheets

DRIVE CIRCUIT FOR ELECTRO-OPTIC APPARATUS, METHOD OF DRIVING THE ELECTRO-OPTIC APPARATUS, ELECTRO-OPTIC APPARATUS, AND ELECTRONIC APPARATUS

BACKGROUND OF THE INVENTION

1. Field of the Invention

The present invention relates to a technical field pertaining to an active matrix drive type liquid crystal device driven by thin film transistors (hereinafter referred to as "TFT" as necessary) or the like, a driving circuit of an electro-optical apparatus based on electroluminescence or the like, an electro-optical apparatus equipped with the driving circuit, a driving method for an electro-optical apparatus, and an electronic apparatus employing the electro-optical apparatus and, more particularly, related to a technical field pertaining to peripheral circuits such as a scanning line driving circuit and a data line driving circuit of a liquid crystal device suitably used as a light valve or the like for a liquid crystal projector.

2. Description of Related Art

Hitherto, when a liquid crystal device is employed as the light valve for this type of liquid crystal projector, there are single-chip type in which only one liquid crystal device that is colored (i.e., a color filter is formed on an opposed substrate) is employed, and multi-chip type in which three colorless (i.e., no color filter is formed) liquid crystal devices for R, G, and B, respectively, are employed. The single-chip type has a simpler constitution, however, the multiple-chip type is more advantageous in that it provides a brighter display screen and higher image quality. According to the multi-chip type, the three color light rays which have been separately light-modulated by three liquid crystal devices are compounded into a single projection light ray through a prism or dichroic mirror, then projected on a screen.

Thus, when the light rays are merged through a prism or the like, as shown in FIG. 16, for example, while light R and light B are reflected by a prism 502 after the modulation through three RGB three light valves 500R, 500G, and 500B, light G is not reflected by the prism 502. This means that the number of light inversions of light G is smaller by one. This phenomenon naturally applies when the optical system is configured such that light R or light B in place of light G is not reflected by the prism 502; this phenomenon also takes place when trichromatic light is compounded using a dichroic mirror or the like. Hence, in such a case, it is necessary to horizontally invert the display image related to light G in some form.

On the other hand, for a commercial strategic reason, there are cases where a single-chip or multi-chip type liquid crystal projector is preferably designed as a floor mounting type so that it can be installed on a floor as a typical installation and also as a hanging type which is mounted on a ceiling upside down. In this case, even for the single-chip type, it is necessary to horizontally or vertically invert the display images supplied to a liquid crystal device according to how the projector is installed. There is another case as in the liquid crystal monitor, which is a single-chip liquid crystal device, of a portable video camera where the liquid crystal is required to be inverted about, for example, a flexible joint, according to the videotaping posture of a user thereof.

Conventionally, therefore, an image signal processing IC for supplying image signals in a predetermined format to a data line driving circuit of a liquid crystal device has been used to generate and supply, for each field, an image signal for handling images obtained by vertically or horizontally inverting original pictures, e.g., only for the image signal of G or of all image signals for all colors. This is convenient because it obviates the need for adding any change to the liquid crystal device or the peripheral circuits thereof.

Or, conventionally, in the case of the multi-chip type liquid crystal projector as described above, for example, in order to compound the light rays of the three colors, a liquid crystal device in which the scanning direction is horizontally inverted as compared to the liquid crystal devices for R and the liquid crystal device for B is employed as the liquid crystal device for G.

According to the conventional method wherein the image signal processing IC is employed to vertically or horizontally invert display images as described above, however, excessive load would be placed on the image signal processing IC to respond to the recent demand for higher image quality and would be impractical.

Furthermore, the method using the liquid crystal device in which the scanning direction is inverted vertically or horizontally poses the following problems. In general, a scanning line driving circuit or a data line driving circuit has a unidirectional shift register which has a fixed direction of transfer and it is constituted so that it supplies a scanning signal or an image signal in line sequence or dot sequence according to the transfer signals generated by the unidirectional shift register thereby to perform vertical or lateral scanning on a display screen. Hence, in the case of the multi-chip type liquid crystal projector, in order to use a liquid crystal device with inverted scanning direction, it is required to fabricate two types of liquid crystal devices, namely, an R-shift type liquid crystal device having its shift register designed such that the data line driving circuit scans from left to right in relation to a display image and an L-shift type liquid crystal device having its shift register designed such that the data line driving circuit scans from right to left in relation to the display image. It is obviously disadvantageous for a manufacturer to fabricate such two types of liquid crystal devices in, for example, the manufacturing process or the like of TFT by a semiconductor manufacturing equipment or the like. Also for the users, there would be a problem in that there is no compatibility between the similar liquid crystal devices and the individual devices can be used only as their types, posing a problem in practical use. Further, the liquid crystal devices with the fixed scanning directions cannot achieve the liquid crystal monitors for the liquid crystal projectors which can be used as the floor-mounting type or the ceiling hanging type as mentioned previously or for the portable video cameras with inverting screens.

In addition, when scanning signals or image signals are supplied to a data line or a group of data lines in accordance with the transfer signals from the shift registers, preceding image signal components are written due to the superimposition or the like of preceding or following image signals supplied to an adjacent data line or an adjacent group of data lines, causing ghosts or uneven images. This problem becomes conspicuous in a high-frequency drive environment.

SUMMARY OF THE INVENTION

The present invention has been made with a view toward solving the problems described above, and it is an object of the present invention to provide a driving circuit of an electro-optical apparatus for an liquid crystal device or the like which permits easy lateral or vertical inversion of the directions of horizontal scanning or vertical scanning by using a relative simple constitution, an electro-optical apparatus equipped with the driving circuit, and electronic apparatus equipped with the electro-optical apparatus.

To solve the aforesaid problems, a driving circuit for a liquid crystal device is made as a driving circuit for an electro-optical apparatus which has a plurality of data lines to which an image signal is supplied, a plurality of scanning lines to which a scanning signal is supplied, a switching means connected to the respective data lines and the respective scanning lines, and a pixel electrode connected to the switching means; and the driving circuit is comprised of a sampling circuit for sampling and supplying the image signal to the data lines and a first bidirectional shift register which has odd number of output stages for supplying a first transfer signal to the sampling circuit; wherein the respective output stages of the first bidirectional shift register are fixed in forward direction or reverse direction in accordance with the binary level of a first direction control signal, and the first transfer signal is supplied in sequence from the respective output stages of the first bidirectional shift register in the fixed transfer direction in accordance with a first clock signal.

According to the driving circuit for the electro-optical apparatus, first, regarding data line driving means, as a first case, when a first direction control signal having one of the levels of the binary level is applied to the first bidirectional shift register from outside, the transfer direction in a first gate means provided at the respective stages of the first bidirectional shift register is fixed in the forward direction (e.g. in the direction from left to right) or the reverse direction (e.g. in the direction from right to left). Under this condition, the first transfer signal is transferred to the following stage of the first bidirectional shift register each time after the change of the binary level of the first clock signal with a predetermined cycle. Hence, the first bidirectional shift register functions as a unidirectional shift register. On the other hand, as a second case, when the first directional control signal having the other level of the binary level is supplied to the first bidirectional shift register from outside, the transfer direction in the first gate means provided at each stage of the first bidirectional shift register is fixed in the reverse direction of the above mentioned first case. In this state, each time after the change of the binary level of the first clock signal with the predetermined cycle, feedback is applied to the first transfer signal by the respective first gate means, and the first transfer signal which has been subjected to the feedback is transferred to the following stage of the first bidirectional shift register. Accordingly, the first bidirectional shift register functions as a unidirectional shift register which has the reverse transfer direction of the first case.

Provided that the first bidirectional shift register is a bidirectional shift register composed of even number of output stages, the first transfer signal, which is output from the first output stage (e.g. the leftmost or rightmost output stage) of the first bidirectional shift register would be inverted according as whether the transfer direction is the forward direction or the reverse direction. For this reason, in order to actually reverse the transfer direction, it is not sufficient to merely change the binary level of the first directional control signal; it is also required to invert the first clock signal (e.g. to invert the phase). Therefore, it would be necessary to provide a mechanism or control for switching the first clock signal in a picture signal processing IC or the like, resulting in a marked disadvantage in constitution and control of the apparatus.

In the present invention, however, the data line driving means in particular comprises a first bidirectional shift register which has odd number of output stages. Hence, regardless of whether the transfer direction is forward or reverse, the transfer signal output from the first output stage (e.g. the leftmost or rightmost output stage) of the first bidirectional shift register will be the same signal. It means that inverting the transfer direction requires only the change of the binary level of the first direction control signal but not requires the inversion of the first clock signal.

Thus, without the need for switching the first clock signal, image signals are sequentially supplied to an odd number of groups of data lines by the data line driving means being in the first direction, which is fixable depending on the first direction control signal level, or in the reverse direction thereof and also being based on the first transfer signal, which is sequentially output from the respective output stages of the first bidirectional shift register.

As a result, according to the driving circuit of the electro-optical apparatus, the horizontal scanning direction of the display image in the liquid crystal device can be easily inverted horizontally merely by changing the level of the first direction control signal.

In order to solve the problems mentioned above, the driving circuit for an electro-optical apparatus is made as a driving circuit for an electro optical apparatus, which has a plurality of data lines to which an image signal is supplied, a plurality of scanning lines to which a scanning signal is supplied, switching means connected to the respective data lines and the respective scanning lines, and a pixel electrode connected to the switching means; and the driving circuit is comprised of a second bidirectional shift register which has an odd number of output stages for supplying a second transfer signal to the scanning lines; wherein each stage of the second bidirectional shift register is fixed in forward direction or reverse direction in accordance with the binary level of a second direction control signal, and the second transfer signal is supplied in sequence from the respective output stages of the second bidirectional shift register in the fixed transfer direction in accordance with of a second clock signal.

According to the driving circuit for the electro-optical apparatus, on one hand, image signals are supplied to the data lines by data line driving means.

On the other hand, regarding scanning line driving means, as a first case, when a second direction control signal having one of the levels of the binary level is applied to the second bidirectional shift register from outside, the transfer direction in a second gate means provided at each stage of the second bidirectional shift register is fixed in the forward direction.(e.g. in the direction from top to bottom) or the reverse direction (e.g. in the direction from bottom to top). In this state, each time after the change of the binary level of the second clock signal with the predetermined cycle, feedback is applied to the second transfer signal by the respective second gate means, and then the second transfer signal which has been subjected to the feedback is transferred to the following stage. Accordingly, the second bidirectional shift register functions as a unidirectional shift register. Contrarily, as a second case, when a second direction control signal having the other level of the binary level is applied to the second bidirectional shift register from outside, the transfer direction in the second gate means provided at each stage of the second bidirectional shift register is fixed in the reverse direction of the aforesaid first case. In this state, each time after the change of the binary level of the second clock signal with the predetermined cycle, feedback is applied to the second transfer signal by the respective second gate means, and the second transfer signal which has been subjected to the feedback is transferred to the following stage. Accordingly, the second bidirectional shift register functions as a unidirectional shift register which has a reverse transfer direction from that in the aforesaid case.

As in the case of the data line driving means as mentioned above, in the present invention, the scanning line driving means is composed of the second bidirectional shift register which has an odd number of output stages. Accordingly, regardless of whether the transfer direction is forward or reverse, the transfer signal output from the first output stage (e.g. the output stage at the top end or the bottom end) of the second bidirectional shift register will be the same signal. This means that inverting the transfer direction requires only the change of the binary level of the second direction control signal but does not require the inversion of the second clock signal.

Thus, without the need for switching the second clock signal, scanning signals are supplied sequentially to the scanning lines by the scanning line driving means being in the second direction, which is fixable depending on the second direction control signal level, or the reverse direction thereof and also being based on the second transfer signal, which is sequentially output from the respective output stages of the second bidirectional shift register.

As a result, according to the driving circuit, the vertical scanning direction of the display image in the liquid crystal device can be easily inverted vertically merely by changing the level of the second direction control signal.

To solve the problems described above, a driving circuit for an electro-optical apparatus is made as a driving circuit for an electro-optical apparatus, wherein a plurality of the data lines are comprised of data line groups, each of which contains a plurality of data lines adjacent each other, wherein the first transfer signal is output in sequence from the respective output stages of the first bidirectional shift register to an odd number of data line groups in the transfer direction of the first direction or the reverse direction of the first direction, and image signal is supplied in sequence for each data line groups based on the first transfer signal.

According to the driving circuit of the electro-optical apparatus, data line driving means is composed of the first bidirectional shift register which has an odd numbered output stages. Hence, regardless whether the transfer direction is forward the reverse, the transfer signal output from the first output stage (e.g. the leftmost or rightmost output stage) from the first bidirectional shift register will be the same signal. This means that inverting the transfer direction requires only the change of the binary level of the first direction control signal but does not require the inversion of the first clock signal. As a result, the horizontal scanning direction in a liquid crystal device can be easily inverted horizontally merely by changing the levels of the first and the second direction control signals.

To solve the problems mentioned above, a driving circuit for an electro-optical apparatus is made as a driving circuit for the electro-optical apparatus, wherein the pulse width of the first transfer signal output from an odd-numbered stage of the first bidirectional shift register is determined to be the same as a predetermined first pulse width by a first waveform selector circuit, while the pulse width of the first transfer signal output from an even-numbered stage of the first bidirectional shift register is determined to be a same as a predetermined second pulse width by a second waveform selector circuit.

According to the driving circuit for the electro-optical apparatus, the pulse width of the first transfer signal output from an odd-numbered stage of the first bidirectional shift register is restricted to the pulse width of the first waveform select signal by the first waveform selector circuit provided for each odd-numbered stage. On the other hand, the pulse width of the first transfer signal output from an even-numbered stage of the first bidirectional shift register is restricted to the pulse width of the second waveform select signal by the second waveform selector circuit provided for the even-numbered stage. Hence, an appropriate time interval is allowed between the image signals which are supplied at about the same time to adjoining groups of data lines. This makes it possible to prevent the problem in which those image signals overlap, especially in a high-frequency drive environment, and ghosts or uneven images occurs resulting from the preceding image signal components which have been written.

Moreover, the data line driving means has an odd number of the first bidirectional shift registers; therefore, inverting the transfer direction requires only the change of the binary level of the first direction control signal but does not require the inversion of the first clock signal or the first and the second waveform select signals.

To solve the problems mentioned above, a driving circuit for an electro-optical apparatus is made as a driving circuit for the electro-optical apparatus, wherein the first waveform selector circuit includes a first logic circuit which takes the AND or exclusive AND of the first transfer signal and the first waveform select signal, while the second waveform selector circuit includes a second logic circuit which takes the AND or exclusive AND of the first transfer signal and the second waveform select signal.

According to the driving circuit for the electro-optical apparatus, the pulse width of the first transfer signal output from an odd-numbered stage of the first bidirectional shift register is restricted to the pulse width of the first waveform select signal by the first logic circuit provided for each odd-numbered stage. Likewise, the pulse width of the first transfer signal output from an even-numbered stage of the first bidirectional shift register can be restricted to the pulse width of the second waveform select signal by the second logic circuit provided for each even-numbered stage.

To solve the problems mentioned above, a driving circuit for an electro-optical apparatus is made as a driving circuit for the electro-optical apparatus, wherein the transition of the pulse waveforms of the first and the second waveform select signals is not rectangular.

According to the driving circuit for the electro-optical apparatus, since the transition of the pulse waveforms of the first and the second waveform select signals are made to be non-rectangular, it is possible to prevent the signal components of the waveform selections signals from being written as noises into the image signals.

To solve the problems mentioned above, a driving circuit for an electro-optical apparatus is made as a driving circuit for the electro-optical apparatus, wherein the transition of the pulse waves is made to be non-rectangular in the range between 20 ns and 50 ns.

According to the driving circuit for the electro-optical apparatus, since the transition of the pulse waves is not rectangular and is not rectangular and is slopped in the range between 20 ns and 50 ns, it is possible to securely prevent the signal components of the waveform select signals from being written as noises into the image signal lines.

To solve the problems mentioned above, a driving circuit for an electro-optical apparatus is made as a driving circuit for the electro-optical apparatus, wherein at least either the first or the second bidirectional shift register includes: a first clocked inverter which can be transferred when the binary level of the first of the second direction transfer signal is at one level and fixes the transfer direction of the first and the second direction transfer signal in the forward direction; a second clocked inverter which can be transferred when the binary level of the first or the second direction transfer signal is at the other certain level and fixes the transfer direction of the first and the second direction transfer signal in the reverse direction, a third clocked inverter which, when the transfer direction of the first and the second direction transfer signal is fixed in the forward direction, transfers the first or second transfer signal, transferred via the first clocked inverter each time after the change of the binary level of the first or the second clock signal, and which, when the transfer direction of the first and the second direction transfer signal is fixed in the reverse direction, applies feedback to the first or the second transfer signal transferred via the second clocked inverter, each time after the change of the binary level of the first or the second clock signal, and a fourth clocked inverter which, when the transfer direction of the first and the second direction transfer signal is fixed in the reverse direction, transfers the first or second transfer signal transferred via the second clocked inverter each time after the change of the binary level of the first or the second clock signal, and which, when the transfer direction of the first and the second direction transfer signal is fixed in the forward direction, applies feedback to the first or the second transfer signal transferred via the first clocked inverter, each time after the change of the binary level of the first or the second clock signal.

According to the driving circuit for the electro-optical apparatus, when the binary level of the first or the second direction control signal is at one level, the transfer direction is fixed in the forward direction by the first clocked inverter which can transfer at that time. When the transfer direction is fixed in the forward direction like this, the first or the second transfer signal transferred via the first clocked inverter is transferred by the third clocked inverter each time after the change of the binary level of the first or the second clock signal. Feedback is applied, by the fourth clocked inverter, to the first or the second transfer signal transferred via the first clocked inverter, each time after the change of the binary level of the first or second clock signal.

Conversely, when the binary level of the first or second direction control signal is at the other level, the transfer direction is fixed in the reverse direction by the second clocked inverter which can transfer at that time. When the transfer direction is fixed in the reverse direction like this, feedback is applied by the third clocked inverter to the first or second transfer signal, which is transferred via the second clocked inverter, each time after the change of the binary level of the first or the second clock signal. And the first or the second transfer signal, which is transferred via the second clocked inverter, is transferred by the fourth clocked inverter each time after the change of the binary level of the first or the second clock signal.

Hence, the first or the second bidirectional shift register constituted as described above functions as a unidirectional shift register having forward or reverse transfer directions, which is determined depending on the binary level of the first or the second direction control signal.

To solve the problems mentioned above, a driving circuit for an electro-optical apparatus is made as a driving circuit for the electro-optical apparatus, wherein at least either the first or the second bidirectional shift register includes: a first transmission gate which can perform transfer and fix the transfer direction in the forward direction when the binary level of the first or the second direction control signal is at one level; a second transmission gate which permits transfer and fixes the transfer direction in the reverse direction when the binary level of the first or the second direction control signal is at the other level, a first clocked inverter which, when the transfer direction is fixed in the forward direction, transfers the first or the second transfer signal transferred via the first transmission gate, each time after the change of the binary level of the first or second clock signal, and which, when the transfer direction is fixed in the reverse direction, transfers the first or the second transfer signal transferred via the second transmission gate, each time after the change of the binary level of the first or the second clock signal, and a second clocked inverter which, when the transfer direction is fixed in the forward direction, applies feedback to the first or the second transfer signal transferred via the first transmission gate, each time the binary level of the first or the second clock signal is switched, and which, when the transfer direction is fixed in the reverse direction, applies feedback to the first or the second transfer signal transferred via the second transmission gate, each time the binary level of the first or second clock signal is switched.

According to the driving circuit for the electro-optical apparatus, when the binary level of the first or second direction control signal is at one level, the transfer direction is fixed in the forward direction by the first transmission gate which enables transfer at that time. When the transfer direction is fixed in the forward direction, the first or the second transfer signal transferred via the first transmission gate is transferred by the first clocked inverter each time the binary level of the first or the second clock signal is switched. Feedback is applied, by the second clocked inverter, to the first or the second transfer signal transferred via the first transmission gate, each time the binary level of the first or the second clock signal is switched.

Conversely, when the binary level of the first or the second direction control.signal is at the other level, the transfer direction is fixed to the reverse direction by the second transmission gate which enables transfer at that time. When the transfer direction is fixed to the reverse direction, the first or the second transfer signal transferred via the second transmission gate is transferred by the first clocked inverter each time the binary level of the first or the second clock signal is switched. Feedback is applied by the second clocked inverter to the first or the second transfer signal, which is transferred via the second transmission gate, each time the binary level of the first or the second clock signal is switched.

Hence, the first or the second bidirectional shift register constituted as described above functions as a unidirectional shift register wherein the forward or reverse transfer direction is determined according to the binary level of the first or the second direction control signal.

Further, the use of the transmission gates obviates the need for routing a power supply, therefore, using the transmission gates for controlling the transfer direction of the bidirectional shift register enables the layout area of the bidirectional shift register to be reduced. This in turn makes it possible to realize a smaller electro-optical apparatus.

To solve the problems mentioned above, a driving circuit for an electro-optical apparatus is made as a driving circuit for the electro-optical apparatus, wherein at least one of the first and the second bidirectional shift register includes: a first transmission gate which enables transfer and fixes the transfer direction in the forward direction when the binary level of the first or the second direction control signal is at one level, a second transmission gate which enables transfer and fixes the transfer direction in the reverse direction when the binary level of the first or the second direction control signal is at the other level; a third transmission gate which, when the transfer direction is fixed to the forward direction, transfers the first or the second transfer signal, which is transferred via the first transmission gate, each time the binary level of the first or the second clock signal is switched, and which, when the transfer direction is fixed in the reverse direction, transfers the first or the second transfer signal, which is transferred via the second transmission gate, each time after the change of the binary level of the first or the second clock signal, and a fourth transmission gate which, when the transfer direction is fixed in the forward direction, applies feedback to the first or the second transfer signal, which is transferred via the first transmission gate, each time the binary level of the first or the second clock signal is switched, and which, when the transfer direction is fixed in the reverse direction, applies feedback to the first or the second transfer signal, which is transferred via the second transmission gate, each time the binary level of the first or the second clock signal is switched.

According to the driving circuit for the electro-optical apparatus, when the binary level of the first or the second direction control signal is at one level, the transfer direction is fixed in the forward direction by the first transmission gate which permits transfer at that time. When the transfer direction is fixed in the forward direction, the first or the second transfer signal transferred via the first transmission gate is transferred by the third transmission gate each time the binary level of the first or the second clock signal is switched. Feedback is applied to the first or the second transfer signal, which is transferred via the first transmission gate, by the fourth transmission gate each time the binary level of the first or the second clock signal is switched.

Conversely, when the binary level of the first or the second direction control signal is at the other level, the transfer direction is fixed to the reverse direction by the second transmission gate which enables transfer at that time. When the transfer direction is fixed to the reverse direction, the first or the second transfer signal, which is transferred via the second transmission gate, is transferred by the third transmission gate each time the binary level of the first or the second clock signal is switched. Feedback is applied to the first or the second transfer signal, which is transferred via the second transmission gate, by the fourth transmission gate each time the binary level of the first or the second clock signal is switched.

Hence, the first or the second bidirectional shift register constituted as described above functions as a unidirectional shift register wherein the forward or reverse transfer direction is determined according to the binary level of the first or the second direction control signal.

The use of the transmission gates obviates the need for routing a power supply, therefore, using the transmission gates for the elements constituting the bidirectional shift register enables the layout area of the bidirectional shift register to be reduced. This in turn makes it possible to realize a smaller electro-optical apparatus.

To solve the problems mentioned above, a driving circuit for an electro-optical apparatus is made as a driving circuit for the electro-optical apparatus, wherein at least one of the first to the fourth clocked inverters is replaced by a transmission gate and an inverter.

According to the driving circuit for the electro-optical apparatus, the transmission gate and inverter, which substitute for at least one of the first to fourth clocked inverters, fix the transfer direction in the forward direction or the reverse direction, or transfer the first or the second transfer signal, or apply feedback to the first or the second transfer signal. Hence, the first or the second bidirectional shift register constituted as described above functions as a unidirectional shift register wherein the forward or reverse transfer direction is determined according to the binary level of the first or the second direction control signal.

Moreover, the use of the transmission gates obviates the need for routing a power supply, therefore, using the transmission gates for the elements constituting the bidirectional shift register enables the layout area of the bidirectional shift register to be reduced. This in turn makes it possible to realize a smaller electro-optical apparatus.

To solve the problems mentioned above, a driving circuit for an electro-optical apparatus is made as a driving circuit for the electro-optical apparatus, wherein at least one of the first to the fourth transmission gates is replaced by a p-channel thin film transistor or an n-channel thin film transistor.

According to the driving circuit for the electro-optical apparatus, by substituting the p-channel thin film transistor or the n-channel thin film transistor for at least one of the first to the fourth transmission gates, the transfer direction is fixed in the forward direction or the reverse direction, or the first or the second transfer signal is transferred, or feedback is applied to the first or the second transfer signal. Hence, the first or the second bidirectional shift register constituted as described above functions as a unidirectional shift register having forward or reverse transfer directions, which is determined depending on the binary level of the first or the second direction control signal.

Moreover, the use of the p-channel thin film transistor or the n-channel thin film transistor reduces the number of the elements to half as compared with using the transmission gates, therefore, using the p-channel thin film transistor or the n-channel thin film transistor for the elements constituting the bidirectional shift register enables the layout area of the bidirectional shift register to be further reduced. This in turn makes it possible to realize a very small electro-optical apparatus.

To solve the problems described above, a driving circuit for an electro-optical apparatus is made as a driving circuit for an electro-optical apparatus which has a plurality of data lines to which an image signal is supplied, a plurality of scanning lines to which a scanning signal is supplied, a switching means connected to the respective data lines and the respective scanning lines, and a pixel electrode connected to the switching means; and the driving circuit is comprised of a sampling circuit for sampling the image signal and supplying it to the data lines, a shift register for supplying a first transfer signal in accordance with a first clock signal, and a plurality of waveform selector circuits which supply a sampling circuit drive signal to the sampling circuit in accordance with the input of the first transfer signal from the shift register and either first and second waveform select signals; wherein the waveform select signals of the first and the second waveform select signals which are different from each other are supplied to adjoining waveform selector circuits, and the pulse of the first waveform select signal is not issued at the same time with the pulse of the second waveform select signal.

According to the driving circuit for the electro-optical apparatus, an appropriate time interval is allowed between the first and the second waveform select signals supplied to adjoining waveform selector circuit, hence, it is possible to prevent ghosts or uneven images caused by the write-in of the image signal components due to the overlap of the image signals. This is especially effective in a high-frequency drive environment.

To solve the problems mentioned above, a driving circuit for an electro-optical apparatus is made as a driving circuit for the electro-optical apparatus, wherein the first waveform selector circuit includes a first logic circuit which takes AND or exclusive AND of the first transfer signal and the first waveform select signal.

According to the driving circuit for the electro-optical apparatus, the pulse width can be restricted to a predetermined pulse width since the first logic circuit which takes AND or exclusive AND of the first transfer signal and the first waveform select signal is included.

To solve the problems mentioned above, a driving circuit for an electro-optical apparatus is made as a driving circuit for the electro-optical apparatus, wherein the transition of the first and the second waveform select signals is not rectangular.

According to the driving circuit for the electro-optical apparatus, by making the pulses non-rectantular, the ringing of the waveform select signal itself can be suppressed, and it is possible to prevent the signal components of the waveform select signals from being written as noises into the image signals.

To solve the problems described above, a driving circuit for an electro-optical apparatus is made as a driving circuit for an electro-optical apparatus, which has a plurality of data lines to which an image signal is supplied, a plurality of scanning lines to which a scanning signal is supplied, switching means connected to the respective data lines and the respective scanning lines, and a pixel electrode connected to the switching means, and the driving circuit comprising a sampling circuit for sampling the image signal and supplying it to the data lines, a shift register for supplying a first transfer signal in accordance with a first clock signal, and a plurality of waveform selector circuits which supply a sampling circuit drive signal to the sampling circuit in accordance with the input of the first transfer signal from the shift register and either two waveform select signals, wherein the pulse width of the waveform select signal is narrower than the pulse width of the first clock signal.

According to the driving circuit for the electro-optical apparatus, an appropriate time interval is allowed between the image signals, which are supplied to the adjoining data lines or the groups of data lines almost at the same time, hence, it is possible to prevent ghosts or uneven images caused by the write-in of image signal components due to the overlap of image signals. This is especially effective in a high-frequency drive environment.

To solve the problems mentioned above, a driving circuit for an electro-optical apparatus is made as a driving circuit for an electro-optical apparatus, which has a plurality of data lines to which an image signal is supplied, a plurality of scanning lines to which a scanning signal is supplied, a switching means connected to the respective data lines and the respective scanning lines, and a pixel electrode connected to the switching means; and the driving circuit is comprised of a sampling circuit for sampling the image signal and supplying it to the data lines, a shift register for supplying a first transfer signal in accordance with the first clock signal, and a plurality of waveform selector circuits which supply the sampling circuit drive signal to the sampling circuit in accordance with the input of the first transfer signal from the shift register and a waveform select signal, wherein the transition of the pulse waveform of the waveform select signal is not rectangular.

According to the driving circuit for the electro-optical apparatus, by making the pulse waveforms non-rectangular, the ringing of the waveform select signal itself can be suppressed, and it is possible to prevent the signal components of the waveform select signals from being written as noises into the image signal lines.

To solve the problems mentioned above, a driving circuit for an electro-optical apparatus is made as a driving circuit for the electro-optical apparatus, wherein the transition of the pulse waves is not rectangular and is not rectangular and is slopped in the range from 20 ns to 50 ns.

According to the driving circuit for the electro-optical apparatus, it is possible to securely prevent the signal components of the waveform select signals from being written as noises into the image signals.

To solve the problems mentioned above, a driving method for an electro-optical apparatus is made as a driving method for an electro-optical apparatus which has a plurality of data lines to which an image signal is supplied, a plurality of scanning lines to which a scanning signal is supplied, a switching means connected to the respective data lines and the respective scanning lines, and a pixel electrode connected to the switching means, and the method is comprised of a step for sampling the image signal according to a sampling control signal which has a pulse width narrower than the pulse width of the first clock signal and supplying it to the data lines, and a step for supplying the sampled image signal via the data lines to the switching means, which is connected to the selected scanning line, while selecting said scanning lines.

According to the driving method for the electro-optical apparatus, an appropriate time interval is allowed between the image signals, which are supplied almost at the same time to the adjoining data lines or the groups of data lines, by the sampling control signal which has the narrower pulse width than the pulse width of the first clock signal, hence, it is possible to prevent ghosts or uneven images caused by the write-in of image signal components due to the overlap of image signals. This is especially effective in a high-frequency drive environment.

To solve the problems described above, a driving method for an electro-optical apparatus has been made as a driving method for an electro-optical apparatus which has a plurality of data lines to which an image signal is supplied, a plurality of scanning lines to which a scanning signal is supplied, a switching means connected to the respective data lines and the respective scanning lines, and a pixel electrode connected to the switching means; and the driving method is comprised of a step for sampling the image signal in accordance with a first transfer signal from a shift register and a sampling circuit drive signal based on the input of either first and second waveform select signals and then supplying it to the data lines, and a step for supplying the sampled image signal via the data lines to the switching means, which is connected to the selected scanning line, while selecting the scanning lines, wherein the first and the second waveform select signals are alternately issued in other words, not issued at the same time.

According to the driving method for the electro-optical apparatus, the image signals are sampled by the sampling circuit driving signals, which are based on the first and second waveform select signals which are issued alternately and not overlapped with each other from the first and second waveform select signal lines to adjoining data lines or groups of data lines. Subsequently the sampled signal is supplied to the data lines. Hence it is possible to protect the data lines from the ghosts or uneven images caused by the write-in of image signal components due to the overlap of image signals. This is especially effective in a high-frequency drive environment.

To solve the problems described above, a driving circuit for an electro-optical apparatus is a driving circuit for an electro-optical apparatus which has a plurality of data lines to which an image signal is supplied, a plurality of scanning lines to which a scanning signal is supplied, a switching means connected to the respective data lines and the respective scanning lines, and a pixel electrode connected to the switching means, and the driving method is comprised of a step for supplying a sampling circuit drive signal to a sampling circuit in accordance with the input of a first clock signal and a waveform select signal, a step for sampling the image signal in accordance with the sampling control signal and supplying it to the data lines, and a step for supplying the sampled image signal via the data lines to the switching means connected to the selected scanning line, while selecting said scanning lines, wherein the transition of the pulse waveform of the waveform select signal being nonrectangular.

According to the driving circuit for the electro-optical apparatus, by making the transition of the pulse waveform non-rectangular, the ringing of the waveform select signal itself can be suppressed, and further it is possible to prevent the signal component of the waveform select signal from being written as a noise into the image signal.

To solve the problems described above, in a driving circuit for an electro-optical apparatus, the transition of the pulse waveform of the waveform select signal is not rectangular and is slopped in the range from 20 ns to 50 ns.

According to the driving circuit for the electro-optical apparatus, it is possible to securely prevent the signal component of the waveform select signal from being written as a noise into the image signal line.

To solve the problems described above, an electro-optical apparatus is equipped with a driving circuit for an electro-optical apparatus.

According to the electro-optical apparatus, it is possible to vertically or horizontally invert the scanning direction in accordance with, for example, the binary level of a first or a second direction control signal. Moreover, it is also possible to protect the data lines from ghosts or uneven images caused by the written-in of the image signal components due to overlap of the image signals.

To solve the problems described above, an electronic apparatus is equipped with the electro-optical apparatus.

According to the electronic apparatus, the aforementioned electro-optical apparatus in accordance with the present invention is included in the electronic apparatus, and the scanning direction on a display screen can be inverted both vertically and horizontally and a display free from uneven images or ghosts can be provided.

The operations and other advantages of the present invention as described above will be made apparent by the embodiments to be given below.

DETAILED DESCRIPTION OF PREFERRED EMBODIMENTS

The embodiments of the present invention will now be described in conjunction with the accompanying drawings.

Figure 1:
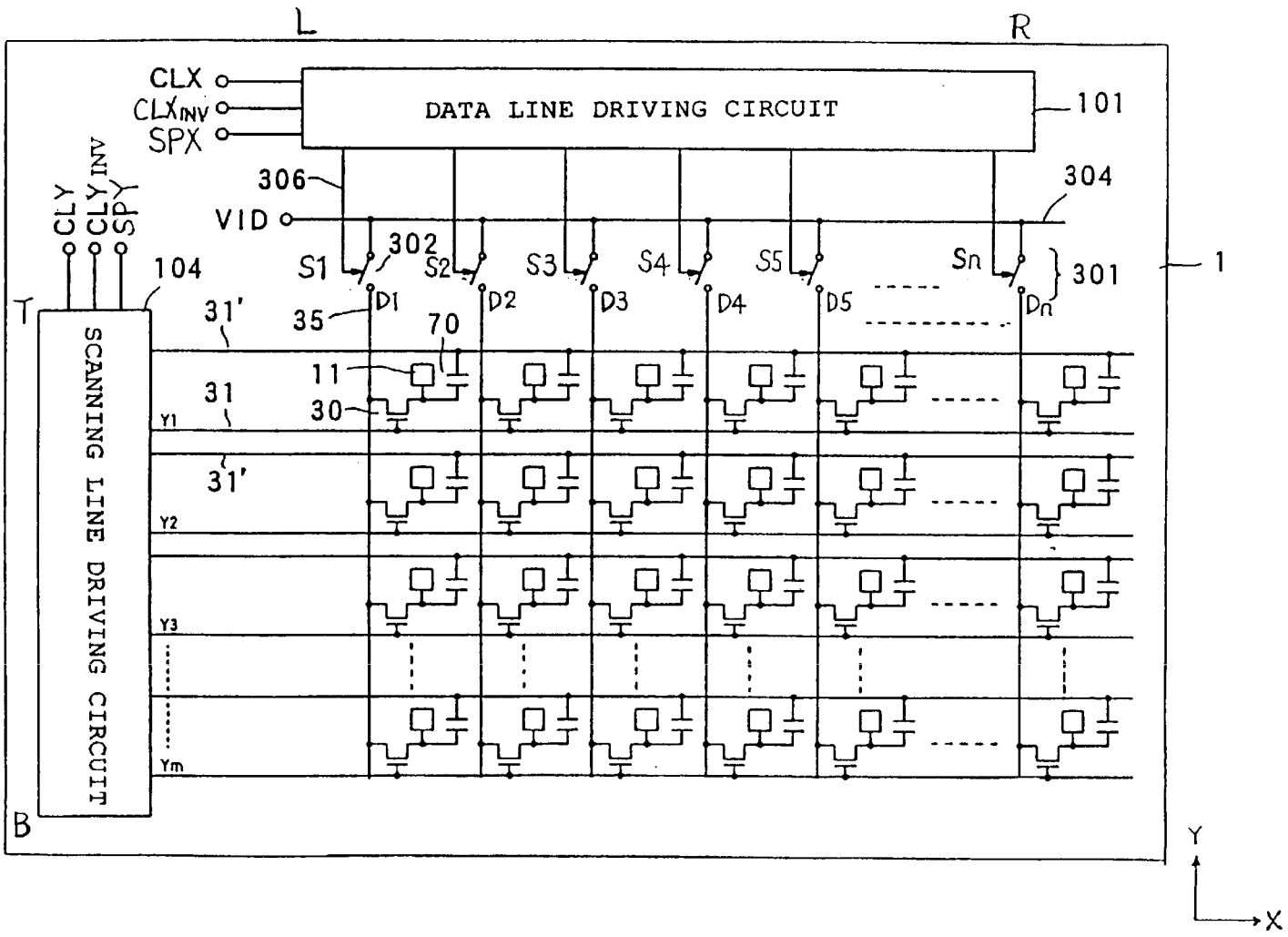
FIG. 1 is a block diagram of various types of wiring, peripheral circuits, etc. formed on a TFT array substrate in an embodiment of a liquid crystal device.

First, the general constitution of the liquid crystal device as an example of an electro-optical apparatus will be described with reference to FIG. 1. FIG. 1 is a block diagram showing the constitution of various types of wiring, peripheral circuits, etc. provided on a TFT array substrate 1 in an embodiment of the liquid crystal device. In this embodiment, the present invention will be applied to an active matrix drive type liquid crystal device based on TFT drive.

In FIG. 1, a TFT array substrate 1 is composed of, for example, a quartz substrate, hard glass or silicon substrate. Formed on the TFT array substrate 1 are a plurality of pixel electrodes 11 provided in matrix, a plurality of data lines 35 which are arranged in direction X and each of which extends in direction Y, and a plurality of scanning lines 31 which are arranged in direction Y and each of which extends in direction X. Further, the scanning line 31 is electrically connected to the gate of a TFT 30; scanning signals Y1, Y2, . . . , Ym are applied in a pulse fashion to the scanning line 31 at a predetermined timing. The pixel electrode 11 is electrically connected to the drain of TFT 30; it writes an image signal VID supplied from an image signal line 304 to the data lines 35 constituted by D1, D2, . . . , Dn when the TFT 30, which is a switching device, is closed for a certain period of time. The image signal VID of the predetermined level which has been written to the liquid crystal via the pixel electrode 11 is retained for a certain period of time between the liquid crystal and an opposite electrode (which will be discussed later) formed on an opposite substrate (which will be discussed later). Further formed on the TFT array substrate 1 are capacity lines 31' (storage capacity electrode) which serve as the wiring for a capacitor 70 and which are formed nearly in parallel to the scanning lines 31 so that the capacitor 70 is added to the pixel electrode 11. This makes it possible to prevent the deterioration of display quality caused by flickers or the like attributable to parasitic capacity. Alternatively, to form the capacitor 70, the scanning line 31 of the preceding stage may be used as the electrode for forming the capacitor. This constitution obviates the need for providing the capacity lines 31'.

The image signal VID written to the data lines 35 may be supplied in line at a time to each of data lines 35 or it may be supplied to each group formed of adjoining plural data lines 35. If a plurality of adjoining data lines 35 are driven at the same time, the drive frequency of a data line driving circuit can be decreased by shifting the phase of the image signal VID, thus higher reliability of and lower power consumption of the circuit can be realized.

Also formed on the TFT array substrate 1 are a sampling circuit 301 which samples the image signals VID and supplies each of them to the data lines 35, a data driving circuit 101, and a scanning line driving circuit 104.

The scanning line driving circuit 104 has a bidirectional shift register which will be discussed later, it generates a scanning signal of a predetermined waveform and a predetermined timing from the transfer signal issued from the bidirectional shift register in accordance with a reference clock signal CLY and its inverted clock signal CL INV, a start signal SPY, etc. supplied from an external control circuit. The scanning signal is applied to the scanning lines 31 in the pulse fashion with line at a timing method. As it will be discussed in detail later, especially, the scanning driving circuit 104 is able to supply scanning signals in sequence in the order from T to B shown in FIG. 1 as well as to supply the scanning signals in sequence in the order from B to T to a plurality of the scanning lines 31 by fixing the transfer direction of the bidirectional shift register in the forward or reverse direction in accordance with a transfer direction control signal supplied from outside.

The data line driving circuit 101 has a bidirectional shift register, which will be discussed later, it generates sampling circuit drive signals S1, S2 . . . Sn of predetermined waveform and predetermined timings from the transfer signal issued from the bidirectional shift register in accordance with a reference clock signal CLX and the inverted signal of the clock signal (hereinafter referred to as "inverted clock signal") CLX INV, a start signal SPX, etc. supplied from an external control circuit.

The sampling circuit 301 has TFT 302 for each of the data lines 35, the image signal line 304 is connected to the source electrodes of the TFTs 302, and sampling circuit drive signal lines 306 are connected to the gate electrodes of the TFTs 302. When the sampling circuit drive signals S1, S2 . . . Sn are applied to the sampling circuit 301 via the sampling circuit drive signal lines 306, the image signal VID supplied from the image signal line 304 is applied to the data lines 35 in the order of D1, D2 . . . Dn. As it will be discussed in detail later, especially, the data line driving circuit 301 is constituted such that it is able to supply the image signal VID to the data line 35 in sequence in the order from L to R as well as in sequence in the order from R to L by fixing the transfer direction of the bidirectional shift register in the forward or reverse direction in accordance with a transfer direction control signal supplied from outside. Thus, this embodiment is constituted to select one data line 35 at a time, however, it may alternatively be constituted to select a plurality of data lines 35 at a time. For instance, according to the writing characteristic of the TFT 302 constituting the sampling circuit 301 and the frequency of the image signal VID, the image signals VID which have been phase-developed into a plurality of phases (e.g. 3 phases, 6 phases, 12 phases and so on) may be supplied from the image signal line 304 so as to sample them by group at the same time. At this time, it is needless to say that the image signal lines 304 of at least the number of the developed phases will be required.

Figure 2:
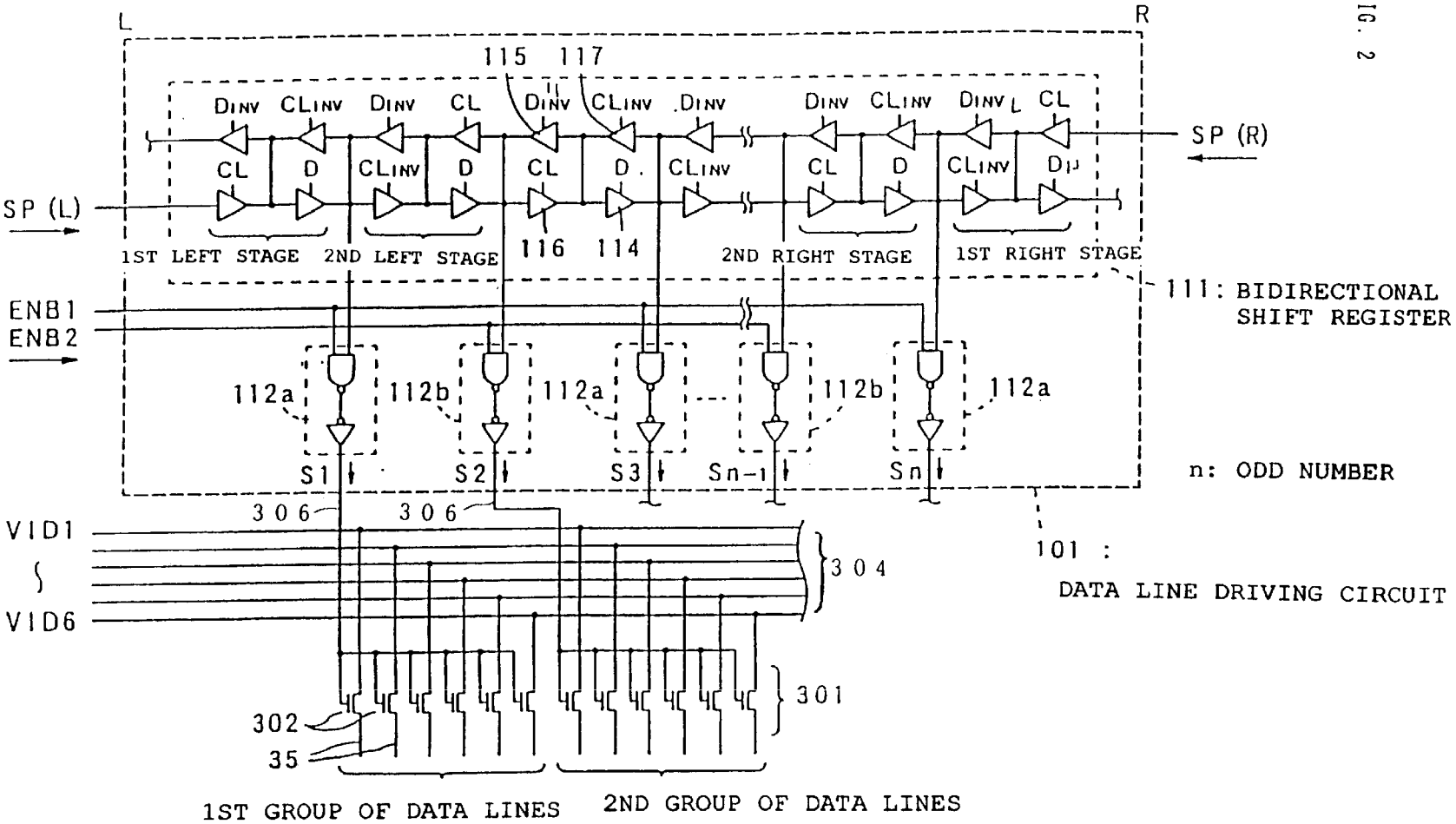
FIG. 2 is a circuit diagram of a first embodiment of a driving circuit provided on the liquid crystal device of FIG. 1.
Figure 3:
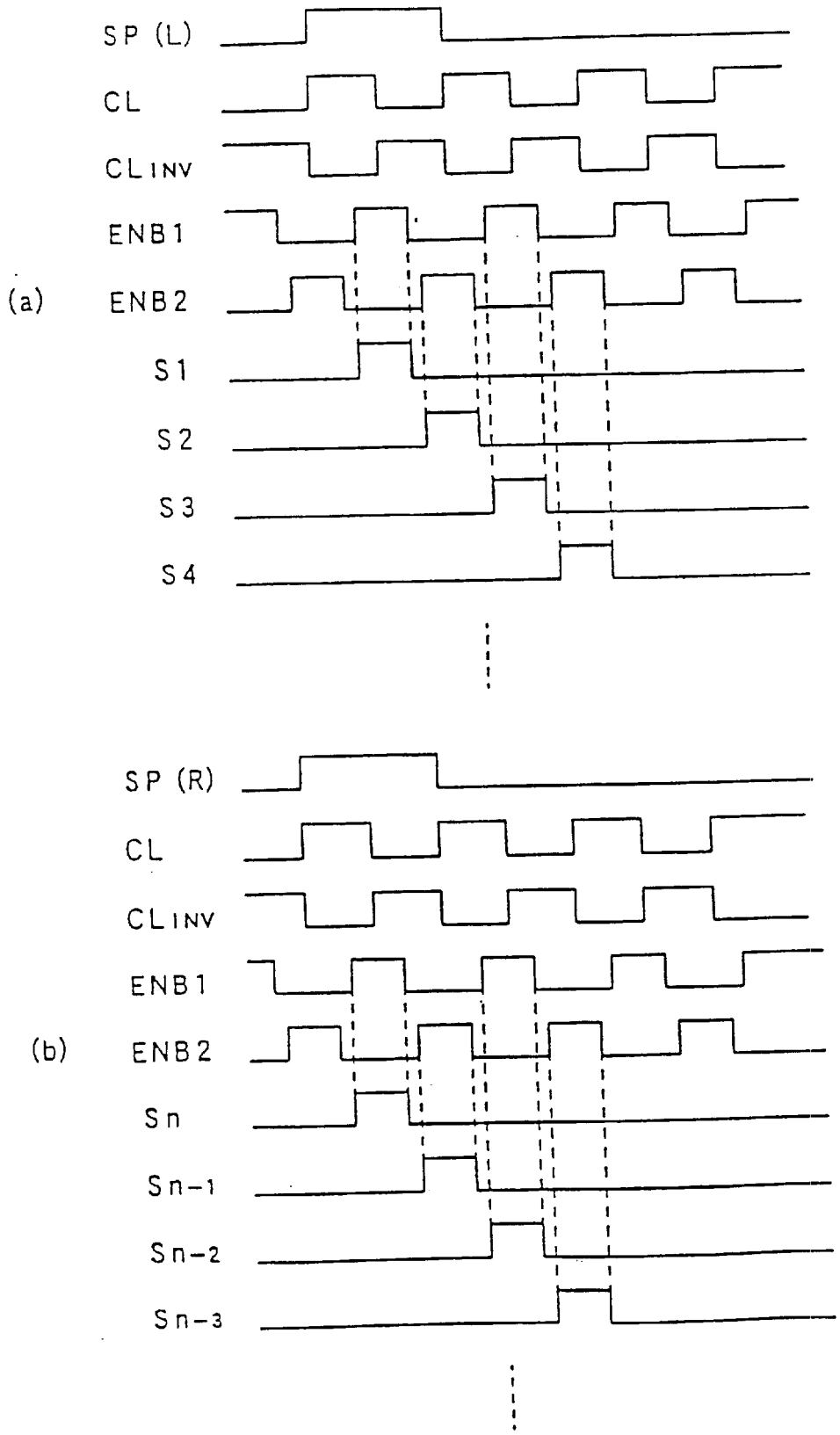
FIG. 3(*a*) and FIG. 3(*b*) are timing charts of various signals in the driving circuit of FIG. 2.
Figure 4:
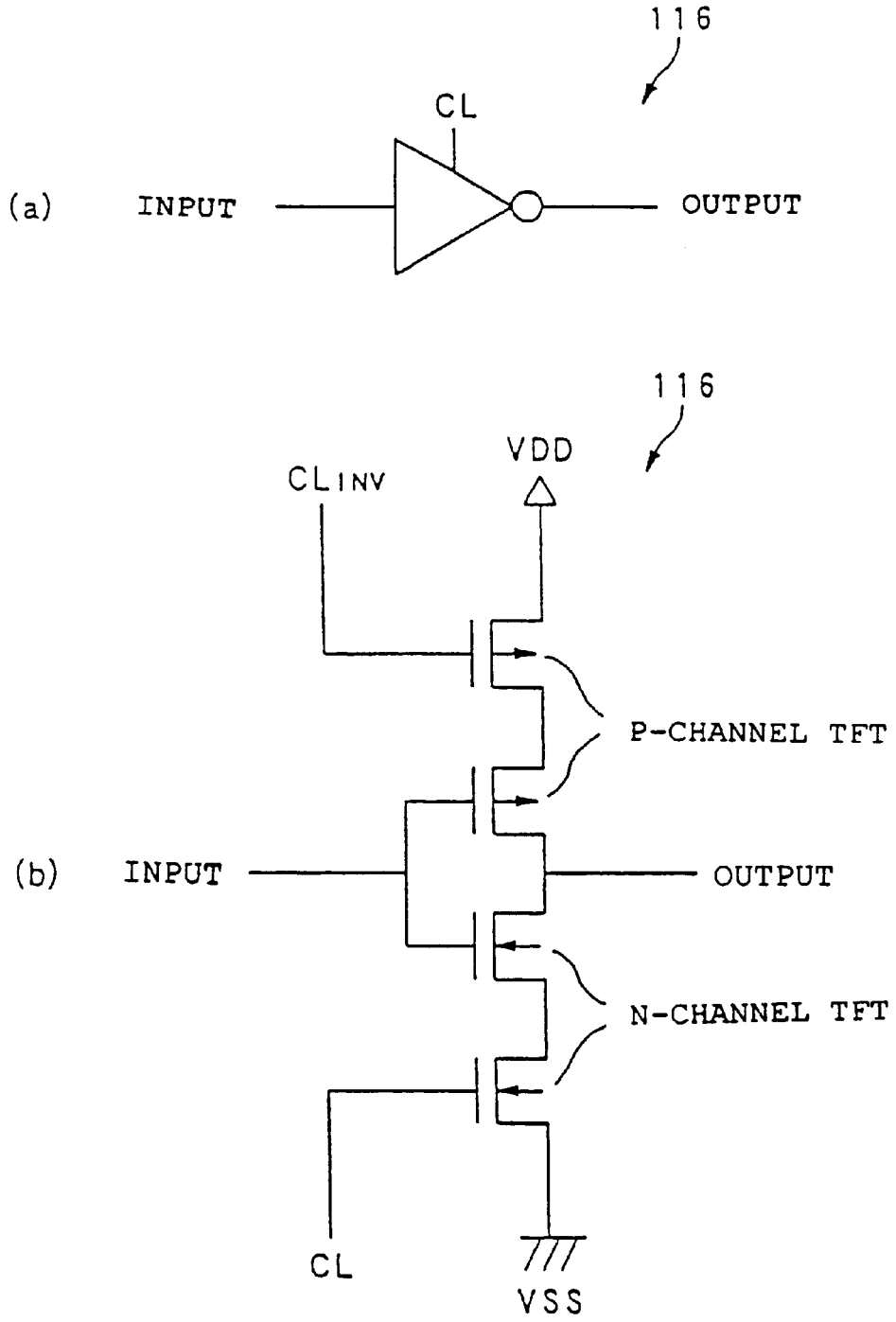
FIG. 4 is a circuit diagram of a clocked inverter constituting the driving circuit of FIG. 2.
Figure 5:
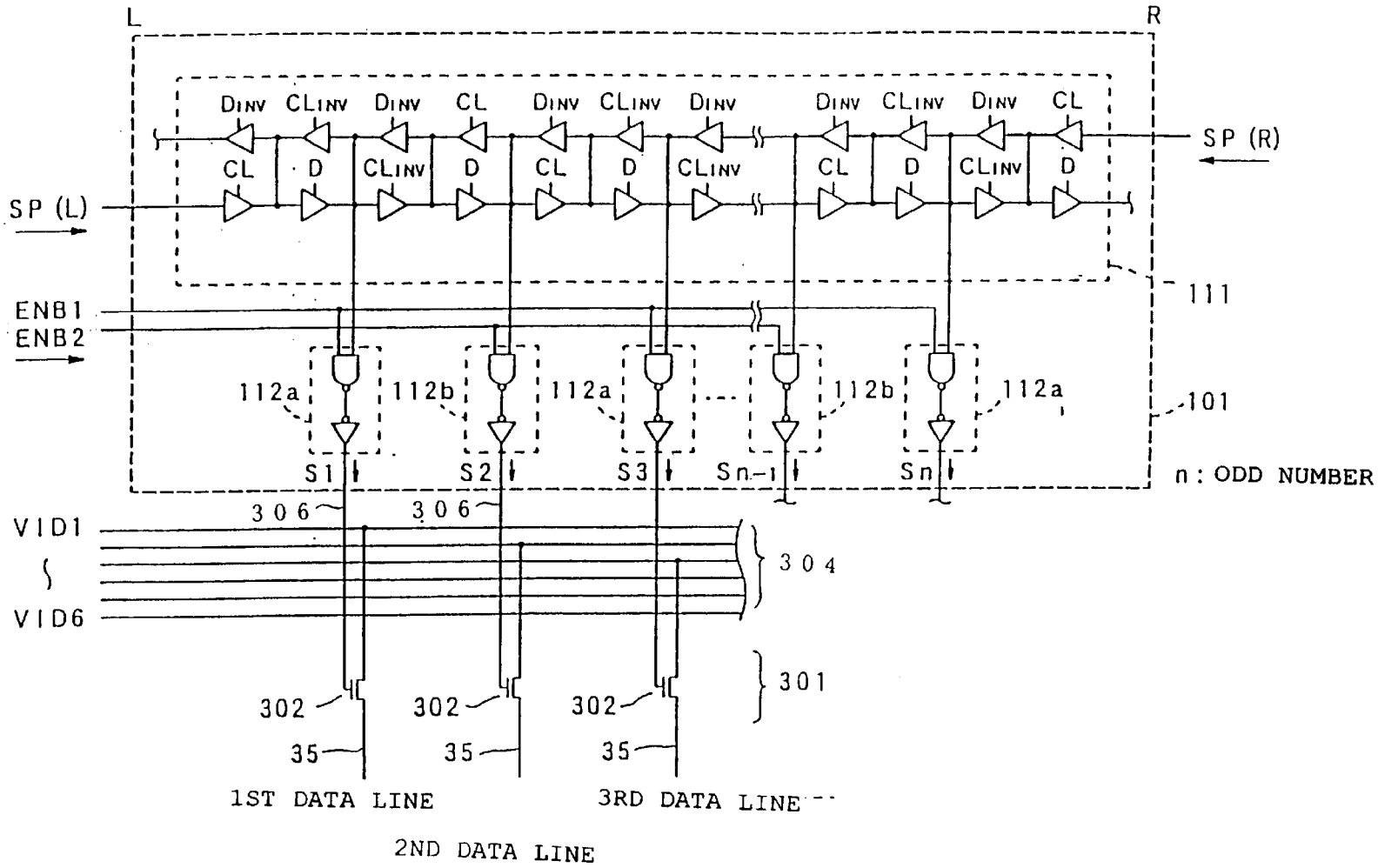
FIG. 5 is a circuit diagram showing a modification wherein the output wiring to the sampling circuit of the driving circuit of FIG. 2 has been changed.

A first embodiment of the driving circuit will be described with reference to FIG. 2 through FIG. 5. FIG. 2 shows a data line driving circuit 101 in the first embodiment. FIG. 2 illustrates a constitution example wherein the image signals issued as serial signals are phase-developed into six parallel image signals and image signals VID1 through VID6 are applied to data lines 35, respectively, via six image signal lines 304. FIGS. 3(*a*) and 3(*b*) show the timing charts of various signals in the data line driving circuit 101. FIGS. 4(*a*) and 4(*b*) show the circuit diagrams of the clocked inverters constituting a bidirectional shift register 111 of the data line driving circuit 101. FIG. 5 shows the modifications of lines 306 of sampling circuit driving signals issued from the data line driving circuit 101 of FIG. 2. First, the data line driving circuit will be described.

In FIG. 2, the data line driving circuit 101 is constituted by the bidirectional shift register 111, a plurality of waveform selector circuits 112*a*, which are provided so that each corresponds to the outputs of odd-numbered stages of the bidirectional shift register 111, and a plurality of waveform selector circuits 112*b* provided for the outputs of even-numbered stages of the bidirectional shift register 111.

In this embodiment, the data line driving circuit 101 in particular, which is an example of the data line driving means, is comprised of the bidirectional shift register 111 which has an odd number of output stages. It is constituted such that it is able to sequentially supply the image signals VID1 through VID6 in cooperation with the sampling circuits 302 to, for example, an odd number of data line groups, each group being comprised of six adjacent data lines 35, in the transfer directions from L to R or from R to L in accordance with the sampling circuit drive signals S1, S2, S3, . . . , Sn issued in sequence from the respective stages of the bidirectional shift register 111. The bidirectional shift register 111 receives, from side L in the drawing, a start signal SP (L) for starting the transfer of the transfer signal directed from L to R, or a start signal SP (R) for starting the transfer of the transfer signal directed from R to L from side R in the drawing. When the start signal SP (L), a clock signal CL, and the inverted clock signal CL INV, and first and second waveform select signals ENB1 and ENB2 are input at the timings shown in FIG. 3(*a*), the data line driving circuit 101 supplies the sampling circuit driving signals S1, S2, S3, . . . , Sn (where "n" denotes an odd number), which are composed of pulses which delay sequentially by a half cycle of the clock signal CL and which have a smaller width than the pulse width of the clock signals CL to the sampling circuit 301.

The bidirectional shift register 111 will now be described in detail.

As shown in FIG. 2, the transfer directions of the respective stages of the bidirectional shift register 111 are fixed in accordance with a binary transfer direction control signal D, which is an example of the first direction control signal, and the inverted signal of the transfer direction control signal (hereinafter referred to as "the inverted transfer direction control signal") D INV. It includes four clocked inverters 114, 115, 116, and 117 which constitute an example of a first gate means which applies feedback to the transfer signals and then transfers them to the following stage and outputs then each time after the change of the binary levels of the reference clock signal CL, which is an example of a first clock signal of a predetermined cycle, and the inverted clock signal CL INV.

The clocked inverter 114, as an example of the first clocked inverter, is constituted and connected such that it permits transfer when the transfer direction control signal D is at high level and fixes the transfer direction to the one from L to R as an example of the forward direction.

The clocked inverter 115, as an example of the second clocked inverter, is constituted and connected such that it permits transfer when the transfer direction control signal D INV is at high level and fixes the transfer direction to the one from R to L as an example of the reverse direction.

The clocked inverter 116, as an example of the third clocked inverter, is constituted and connected such that, if the transfer direction is fixed to the one from L to R, then it transfers the transfer signal, which is transferred via the clocked inverter 114, when the clock signal CL is at high level, and while, if the transfer direction is fixed in the direction from R to L, then it applies feedback to the transfer signal, which is transferred via the clocked inverter 115, when the clock signal CL is at high level.

The clocked inverter 117, as an example of the fourth clocked inverter 117, is constituted and connected such that, if the transfer direction is fixed in the direction from R to L, then it transfers the transfer signal, which is transferred via the clocked inverter 115, when the inverted clock signal CL INV is at high level, and while, if the transfer direction is fixed in the direction from L to R, then it applies feedback to the transfer signal, which is transferred via the clocked inverter 114, when the inverted clock signal CL INV is at high level.

The specific circuit configuration of the clocked inverter 116 shown in FIG. 4(*a*) is given as a connection diagram in FIG. 4(*b*). The same circuit configuration applies to all other clocked inverters 114, 115, and 117 except that the clock signal CL and the inverted clock signal CL INV applied to a clock input terminal are replaced by the transfer direction control signal D and the inverted transfer direction control signal D INV, the inverted transfer direction control signal D INV and the transfer direction control signal D, and the inverted clock signal CL INV and the clock signal CL, respectively.

As shown in FIG. 4(*b*), in the clocked inverter 116, an n-channel TFT which receives the clock signal CL through the gate thereof, a p-channel TFT to which the inverted clock signal CL INV is applied, a p-channel TFT and an n-channel TFT which are connected in parallel so that the transfer signals are applied to the respective gates thereof, and power supplies VSS (grounded potential power supply) and VDD (high potential power supply) are connected as illustrated. Thus, the respective clocked inverters require the power supplies VSS and VDD, therefore, the power source wiring must be routed to all the clocked inverters in the entire bidirectional shift register 111 shown in FIG. 2. Further, in each clocked inverter, the input terminal and the output terminal thereof are insulated by the gate insulating film of each TFT, thus providing an advantage in that there is not current leakage against the transfer direction even when the frequency of the transfer signal is high. This leads to an advantage in that the bidirectional shift register 111 is capable of issuing stable transfer signals at high frequencies.

The waveform selector circuits 112*a* and 112*b* will now be described.

In FIG. 2, the waveform selector circuit 112*a* is configured so as to restrict the pulse width of the transfer signal issued from an odd-numbered stage of the bidirectional shift register 111 to the pulse width of the first waveform select signal ENB1. The waveform selector circuit 112*a* is composed of, for example, a NAND circuit which constitutes an example of a first logic circuit and which takes an exclusive AND of a transfer signal and the waveform select signal ENB1, and an inverter circuit which inverts the result, as shown in FIG. 2, by such logical operation, it restricts the pulse width of a transfer signal to the pulse width of the signal ENB1 as illustrated in FIGS. 3(*a*) and 3(*b*).

The waveform selector circuit 112*b* is configured so as to restrict the pulse width of the transfer signal issued from an even-numbered stage of the bidirectional shift register 111 to the pulse width of the second waveform select signal ENB2. The waveform selector circuit 112*b* is composed of, for example, a NAND circuit which constitutes an example of a second logic circuit and which takes an exclusive AND of a transfer signal and the waveform select signal ENB2, and an inverter circuit which inverts the result, as shown in FIG. 2, by such logical operation, it restricts the pulse width of a transfer signal to the pulse width of the signal ENB2 as illustrated in FIGS. 3(*a*) and 3(*b*).

The operation of the data line driving circuit 101 constituted as mentioned above will now be described.

As a first case in FIG. 2, when the transfer direction control signal D is fixed at high level and the inverted transfer direction control signal D INV is fixed at low level and the signals are applied to the bidirectional shift register 111, the transfer direction is fixed in the direction from L to R by the clocked inverter 114 which is provided at each stage of the bidirectional shift register 111 and which permits transfer under this condition and also by the clocked inverter 115 which does not permit transfer under this condition. Under this condition, if the signal SP (L) for starting the transfer is supplied, then the clocked inverters 116 and 117, to which the clock signal CL and the inverted clock signal CL INV are supplied, respectively perform transfer and feedback each time after the change of the binary level of the clock signal CL and the inverted clock signal CL INV as illustrated in FIG. 3(*a*). And the transfer signal, which has been subjected to the feedback is transferred to the following stage (the stage on the R end) of the bidirectional shift register 111 and also issued to the corresponding waveform selector circuit 112*a* or 112*b*. Since the feedback is applied at each stage, the transfer signals are transferred to the following stages in sequence without being non-rectangular.

On the other hand, as a second case in FIG. 2, when the transfer direction control signal D is fixed at low level and the inverted transfer direction control signal D INV is fixed at high level and the signals are applied to the bidirectional shift register 111, the transfer direction is fixed in the direction from R to L by the clocked inverter 114 which is provided at each stage of the bidirectional shift register 111 and which does not permit transfer under this condition and also by the clocked inverter 115 which permits transfer under this condition. Under this condition, if the start signal SP (R) for starting the transfer is supplied, then the clocked inverters 116 and 117, to which the clock signal CL and the inverted clock signal CL INV are supplied, respectively perform feedback and transfer each time after the change of the binary level of the clock signal CL and the inverted clock signal CL INV as illustrated in FIG. 3(*b*). And the transfer signal, which has been subjected to the feedback is transferred to the following stage (the stage on the L end) of the bidirectional shift register 111 and also issued to the corresponding waveform selector circuit 112*a* or 112*b*.

If the bidirectional shift register 111 is a bidirectional shift register having an even number of stages, then the transfer signal issued from the first stage (e.g. the stage at the most L end or at the most R end) of the bidirectional shift resister 111 would have a phase, which shifts by half the cycle of the clock signal CL depending on whether the transfer is directed from L to R or from R to L. For this reason, in order to actually invert the transfer direction and to perform image display on a liquid crystal 10 without any trouble, it is not sufficient to change merely the binary level of the transfer direction control signal D and the inverted transfer direction control signal D INV, but it is also required to invert the clock signal CL and the inverted clock signal CL INV, respectively. It means that, in this case, it would be necessary to change the wiring of the clock signal CL and the inverted clock signal CL INV somewhere. In this embodiment, however, is constituted such that the bidirectional shift register 111 has an odd number of output stages. Hence, as shown in FIGS. 3(*a*) and 3(*b*), the transfer signal issued from the first stage (leftmost or rightmost stage) of the bidirectional shift register 111 will be an identical signal regardless whether the transfer direction is from L to R or from R to L. This means that the requirement for inverting the transfer direction is merely changing the binary level of the transfer direction control signal D and the inverted transfer direction control signal D INV, and inverting the clock signal CL and the inverted clock CL INV is not necessary. This leads to a great advantage in the aspects of both constitution and control of the apparatus.

Likewise, in the case of the waveform selector circuit, if the bidirectional shift register has an even number of output stages, regarding the waveform select signal ENB1 supplied to the waveform selector circuit 112*a* controlled by the output signals from odd-numbered stages of the bidirectional shift register and the waveform select signal ENB2 supplied to the waveform selector circuit 112*b* controlled by the output signals from the even-numbered stages of the bidirectional shift register, the waveform select signals ENB1 and ENB2 must be switched each time the transfer direction is inverted. In this embodiment, however, the bidirectional shift register 111 is constituted so as to have an odd number of output stages. Hence, as shown in FIGS. 3(*a*) and 3(*b*), the output signal issued from the first stage (leftmost or rightmost stage) of the bidirectional shift register 111 will be an identical signal regardless whether the transfer direction is from L to R or from R to L. This means that inverting the transfer direction requires merely changing the binary level of the transfer direction control signal D and the inverted transfer direction control signal D INV, and it is not necessary to invert the waveform select signals ENB1 and ENB2. This leads to a great advantage in the aspects of both constitution and control of the apparatus.

Thus, in an image signal processing IC or the like, it is no longer necessary to provide a mechanism or control for switching the clock signals by using a memory or the like. This is advantageous in cost as well as constitution and control of the liquid crystal device 10. In generally, this type of switching in particular becomes more difficult as the drive frequency increases, therefore, the feature is extremely effective for the data line driving circuit 101 with a high drive frequency.

As described above, when the transfer signals are output in sequence from the respective stages of the bidirectional shift register 111 in the direction from L to R or from R to L, the waveform select signals 112*a* and 112*b* perform the operations described below.

The pulse width of the transfer signal issued from an odd-numbered stage of the bidirectional shift register 111 is restricted to the pulse width of the first waveform select signal ENB1 by the waveform selector circuit 112*a* as illustrated in FIGS. 3(*a*) or 3(*b*). The pulse width of the transfer signal issued from an even-numbered stage of the bidirectional shift register 111 is restricted to the pulse width of the second waveform select signal ENB2 by the waveform selector circuit 112*b*, as illustrated in FIGS. 3(*a*) or 3(*b*). After that, these transfer signals with the restricted pulse widths are supplied in sequence as the sampling circuit drive signals S1, S2, . . . , Sn (where "n" is an odd number) to the sampling circuit 301, as shown in FIG. 3(*a*), if the transfer direction is from R to L. Or, if the transfer direction is from L to R, then the transfer signals are supplied in sequence as sampling circuit drive signals Sn, Sn-1, Sn-2, . . . , Si to the sampling circuit 301, as shown in FIG. 3(*b*).

Hence, appropriate time intervals are allowed between the image signals supplied to adjoining data line groups at about the same time in accordance with the signals S1, S2, Sn, having an appropriate time intervals allowed by the restriction of the pulse width. Thus, the appropriate time intervals allowed between the image signals makes it possible to prevent the ghosts or uneven images caused by write-in any preceding image signal components that have been written because of the overlap of the image signals especially under a high-frequency drive environment, leading to a great advantage.

As mentioned above, the sampling circuit drive signals S1, S2, . . . , Sn, or Sn, Sn-1, Sn-2, . . . , S1 (where "n" is an odd number), which have been generated by restricting the pulse widths by the waveform selector circuits 112*a* and 112*b*, are simultaneously supplied to the gates of six TFTs 302 constituting the sampling circuit 301 in the data line group composed, for example, of six adjoining data lines corresponding to the respective image signals VID1 through VID6 which have been developed into six phases. According to this, the data lines 35 is driven by six at each time. This operation is repeated to supply the image signals in sequence to each data line group comprised of six data lines.

The image signals are supplied to one group of data lines in accordance with the same transfer signal, hence, it is desirable to equalize the number of the data lines 35 constituting the data line group with the number of developed phases of the image signals applied from the image signal processing IC to the data line driving circuit 101. For this reason, if there is no developed phases in a certain image signal format or if the interrupt capabilities of the respective TFTs 302 are high, or if the sampling circuit 302 is given a sufficient writing time, then the data line group may be composed, for example, of one data line, as shown in FIG. 5.

FIG. 5 shows a modification of the sampling circuit drive signal line 306, the each signal of which is issued from the data line driving circuit 101 of FIG. 2. In FIG. 5, the configuration of the data line driving circuit 101 is the same as that of FIG. 2, however, each of the TFTs 302 of the sampling circuit 301 is connected to a single waveform selector circuit 112*a* or 112*b*. As a result, the data lines 35 are driven one by one in sequence by the data line driving circuit 101.

The scanning line driving circuit will now be described.

The scanning line driving circuit 104 as an example of the scanning line driving means has the bidirectional shift register 111 which has an odd number of output stages shown in FIG. 2. As in the case of the data line driving circuit 101, the output of the transfer signal in each stage is connected to the scanning line 31. The transfer signals issued in sequence from the respective stages of the bidirectional shift register 111 are supplied to the scanning line 31 as scanning signals just as they are or as scanning signals, which is changed via the waveform selector circuits 112*a* and 112*b* shown in FIG. 2 as in the case of the data line driving circuit 101, in the transfer direction corresponding to the direction from T to B or from B to T.

In this case, the configuration of the bidirectional shift register 111 is the same, however, either of the signals can be employed as the transfer direction control signal, namely, the transfer direction control signal D and the inverted transfer direction control signal D INV, which are same as those of the data line driving circuit 101 or a transfer direction control signal dedicated to the scanning line driving circuit 104. Using the same transfer direction control signal D and the inverted transfer direction control signal D INV enables the switching of the transfer directions of the data line driving circuit 101 and the scanning line driving circuit 104 to be performed being fully interlocked. While, using the dedicated transfer direction control signal makes it possible to independently switch the transfer directions of the data line driving circuit 101 and the scanning line driving circuit 104.

The clock signal for the scanning line driving circuit 104 may have a lower frequency than the clock signals CL and CL INV of the data line driving circuit 101 unless special high-speed drive such as multisync drive is carried out although it depends on the total number of the scanning lines 31 and the length of the period of the vertical scanning. Further, if it is possible to substantially prevent the scanning signals, which are supplied to adjoining scanning lines 31, from being overlapped by setting the clock frequency in the scanning line driving circuit 104 at a low level, then the waveform selector circuits 112*a* and *b*, which are controlled by external waveform select signals, can be omitted in the scanning line driving circuit 104.

Figure 6:
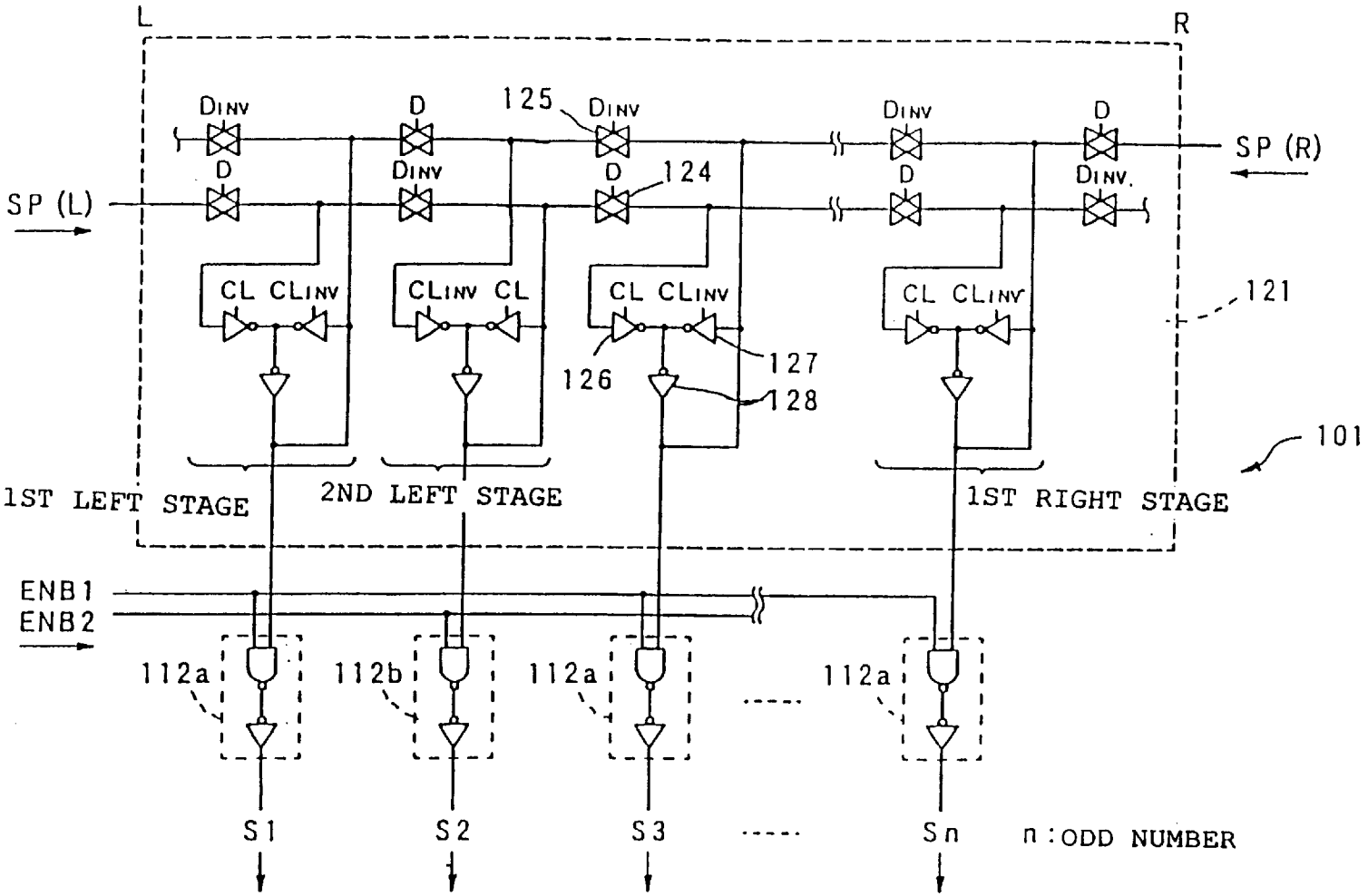
FIG. 6 is a circuit diagram of a second embodiment of the driving circuit provided on the liquid crystal device of FIG. 1.
Figure 7:
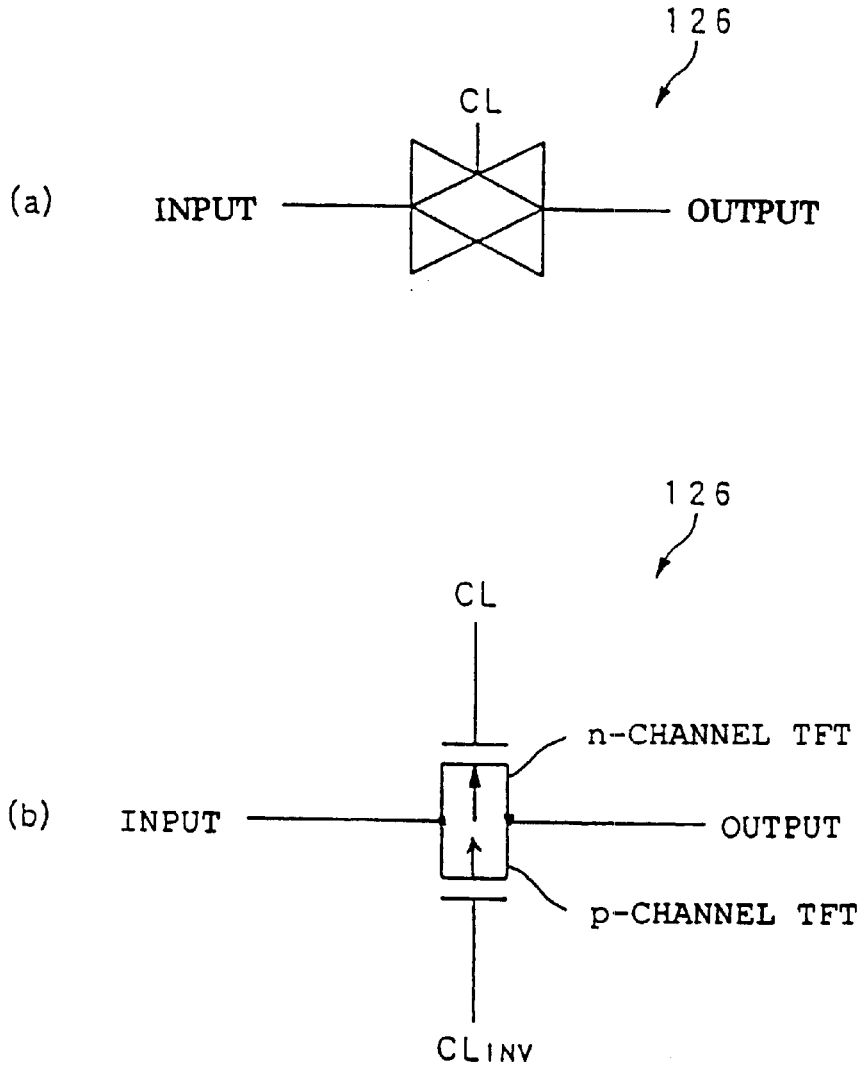
FIG. 7 is a circuit diagram of a transmission gate constituting the driving circuit of FIG. 6.

A second embodiment of the driving circuit will now be described with reference to FIG. 6 and FIG. 7. FIG. 6 shows the data line driving circuit 101 in the second embodiment. FIG. 7 shows the circuit diagrams of the transmission gates constituting the bidirectional shift register of the data line driving circuit 101. The constituent elements, which are the same as those of the first embodiment shown in FIG. 2, are given the same reference numerals and the description thereof will be omitted.

In FIG. 6, the data line driving circuit 101 is equipped with a bidirectional shift register 121 which has an odd number of output stages, each stage of the bidirectional shift register 121 includes two transmission gates 124 and 125 constituting another example of the first gate means and two clocked inverters 126 and 127.

The transmission gate 124, as an example of the first transmission gate, is constituted and connected such that it permits the transfer and fixes the transfer direction to the one from L to R when the transfer direction control signal D is at high level.

The transmission gate 125, as an example of the second transmission gate, is constituted and connected such that it permits the transfer and fixes the transfer direction to the one from R to L when the inverted transfer direction control signal D INV is at high level.

The clocked inverter 126, as another example of the first clocked inverter, is constituted and connected such that, if the transfer direction is fixed to the one from L to R, then the clocked inverter 126 transfers the transfer signal, which is transferred via the transmission gate 124, when the clock signal CL is at high level. If the transfer direction is fixed to the one from R to L, then the clocked inverter 126 transfers the transfer signal, which is transferred via the transmission gate 125, when the clock signal CL is at high level.

The clocked inverter 127, as another example of the second clocked inverter, is constituted and connected such that, if the transfer direction is fixed to the one from R to L, then the clocked inverter 127 applies feedback to the transfer signal, which is transferred via the transmission gate 125, before or after the inverter 128, when the inverted clock signal CL INV is at high level. If the transfer direction is fixed to the one from L to R, then the clocked inverter 127 applies feedback to the transfer signal, which is transferred via the transmission gate 124, before or after the inverter 128, when the inverted clock signal CL INV is at high level.

The specific circuit configuration of the transmission gate 126 shown in FIG. 7(*a*) is shown by a circuit diagram in FIG. 7(*b*). The same circuit configuration applies to another transmission gate 127 except that the clock signal CL and the inverted clock signal CL INV applied to a clock input terminal are replaced by the inverted transfer direction control signal D INV and the transfer direction control signal D, respectively.

In the transmission gate 126, the n-channel TFT which receives the clock signal CL through the gate thereof and the p-channel TFT which receives the inverted clock signal CL INV are connected as illustrated so that the transfer signals are transferred between the source and the drain. Thus, neither of the transmission gates requires power supply, providing an advantage in that there is no need to route power wiring to the respective transmission gates in the entire bidirectional shift register 121. This makes it possible to reduce the layout area for the data line driving circuit 101 and the scanning line driving circuit 104, permitting a smaller liquid crystal device to be achieved.

Because of the constitution as described above, the bidirectional shift register 121 functions as a unidirectional shift register having transfer directions from L to R or from R to L, which is determined depending on the binary level of the transfer direction control signal D and the inverted transfer direction control signal D INV.

The waveform selector circuits 112*a* and 112*b* are the same as those of the first embodiment.

The description of the scanning line driving circuit in the second embodiment will be omitted because it may be constituted in the same manner as that for the scanning line driving circuit 104 in the first embodiment by using the bidirectional shift register 111 or 121.

Figure 8:
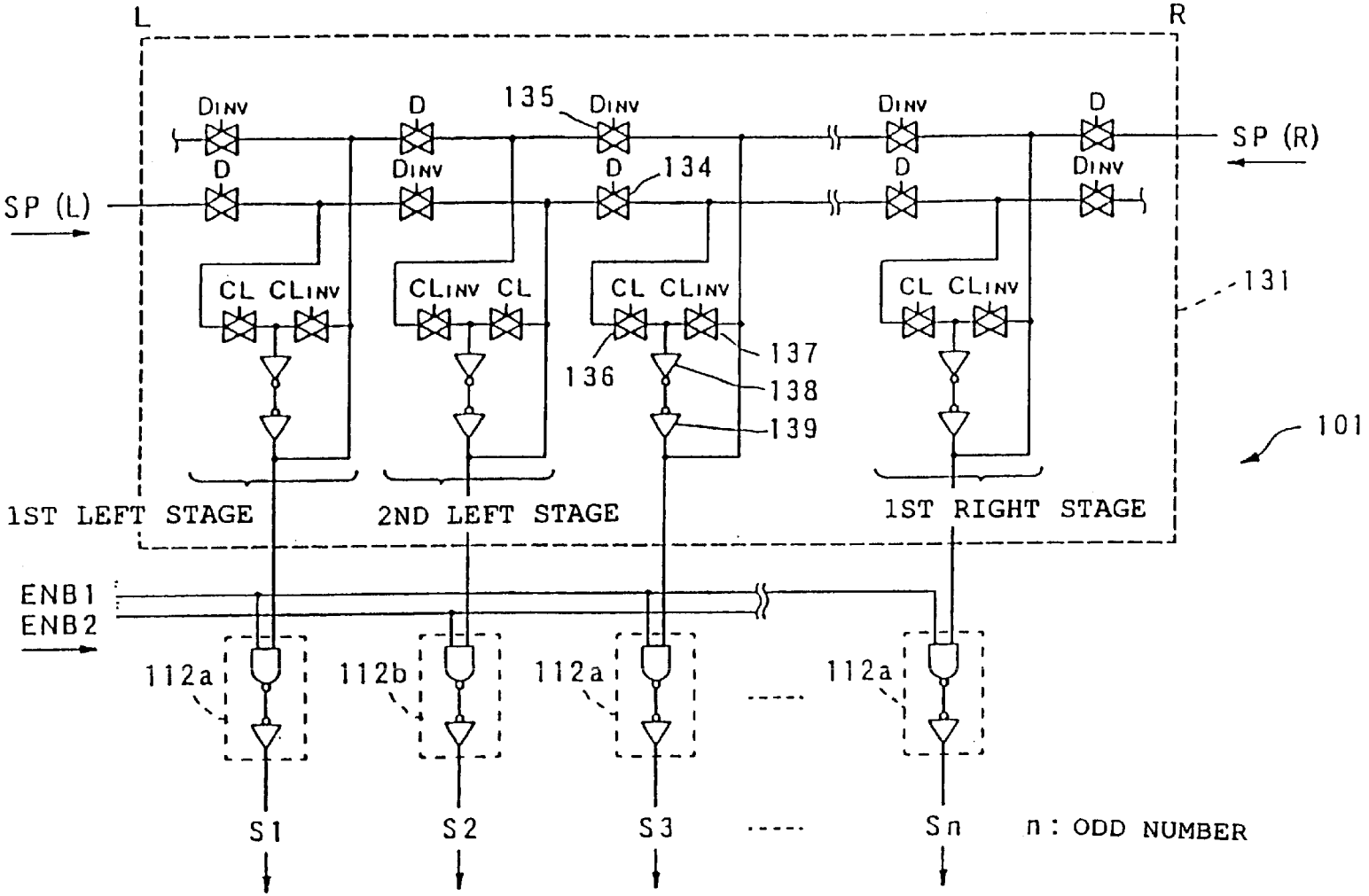
FIG. 8 is a circuit diagram of a third embodiment of the driving circuit provided on the liquid crystal device of FIG. 1.

A third embodiment of the driving circuit will now be described with reference to FIG. 8. FIG. 8 shows the data line driving circuit in the third embodiment. The composing elements, which are same as those of the first embodiment shown in FIG. 2, are given same reference numerals and the description thereof will be omitted.

In FIG. 8, the data line driving circuit 101 is equipped with a bidirectional shift register 131 which has an odd number of output stages. Each stage of the bidirectional shift register 131 includes four transmission gates 134 through 137 constituting another example of the first gate means.

The transmission gate 134, as another example, of the first transmission gate is constituted such that it permits transfer and fixes the transfer direction to the one from L to R when the transfer direction control signal D is at high level.

The transmission gate 135, as another example of the second transmission gate, is constituted such that it permits transfer and fixes the transfer direction to the one from R to L when the inverted transfer direction control signal D INV is at high level.

The transmission gate 136, as an example of the third transmission gate, is constituted and connected such that, if the transfer direction is fixed to the one from L to R, then it transfers the transfer signal, which is transferred via the transmission gate 134, when the clock signal CL is at high level. If the transfer direction is fixed to the one from R to L, then it transfers the transfer signal, which is transferred via the transmission gate 135, when the clock signal CL is at high level.

The transmission gate 137, as an example of the fourth transmission gate, is constituted such that, if the transfer direction is fixed to the one from R to L, then the transmission gate 137 applies feedback to the transfer signal, which is transferred via the transmission gate 135, before or after the inverters 138 and 139 when the inverted clock signal CL INV is at high level. If the transfer direction is fixed to the one from L to R, then the transmission gate 137 applies feedback to the transfer signal, which is transferred via the transmission gate 134, before or after the inverters 138 and 139 when the inverted clock signal CL INV is at high level.

Because of the constitution as described above, the bidirectional shift register 131 functions as a unidirectional shift register having the transfer directions from L to R or from R to L, which is decided according to the binary level of the transfer direction control signal D and the inverted transfer direction control signal D INV.

Moreover, in this embodiment, the circuit constituting the bidirectional shift register 131 is formed using the transmission gates, thus it is not necessary to route a power supply to the bidirectional shift register 131. This makes it possible to reduce the layout area for the data line driving circuit 101 and the scanning line driving circuit 104, permitting a smaller liquid crystal device to be achieved.

The waveform selector circuits 112*a* and 112*b* are the same as those of the first embodiment.

The description of the scanning line driving circuit in the third embodiment will be omitted because it may be constituted in the same manner as that for the scanning line driving circuit 104 in the first embodiment by using the bidirectional register 111, 121 or 131.

(Modifications of the Driving Circuit)

A modification of the driving circuit will now be described with reference to FIG. 9 and FIG. 10. Each of the modifications will relate to modified bidirectional shift registers, so that description will be given only about this aspect.

Figure 9:
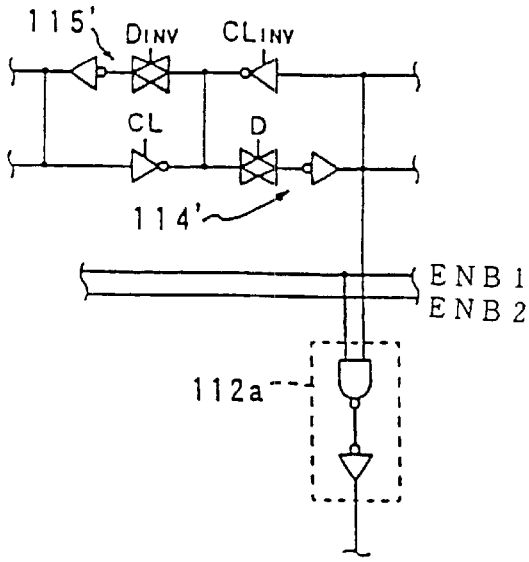
FIG. 9 is a circuit diagram illustrative of a first modification of the driving circuit of FIG. 2.
Figure 10:
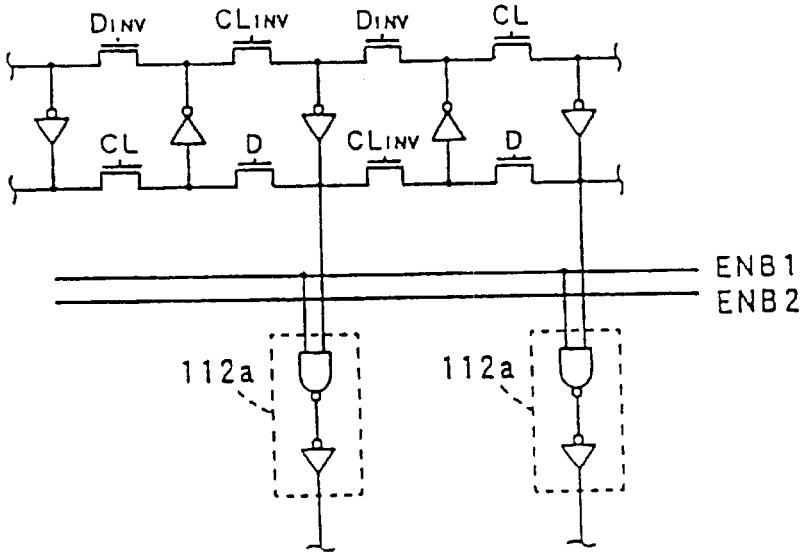
FIG. 10 is a circuit diagram illustrative of a second modification of the driving circuit of FIG. 2.

A first modification employs "a transmission gate+inverter" 114' and "a transmission+inverter" 115' respectively as shown in FIG. 9 in place of the clocked inverters 114 and 115 for fixing the transfer direction in the first embodiment (see FIG. 2) described above. Thus, when the transfer direction control signal D and the inverted transfer direction control signal D INV are applied to the "transmission gates+inverters 114' and 115'", the embodiment functions as a unidirectional shift register having the transfer directions from L to R or from R to L, which is decided in accordance with the binary level of the signals. In this case, in comparison with the first embodiment, since the transmission gates do not require power supplies as illustrated in FIG. 7(*b*), the layout area for a peripheral circuit can be reduced, permitting a smaller liquid crystal device to be accomplished.

A second modification employs a p-channel TFT or an n-channel TFT in place of at least one of the transmission gates 124, 125 and 134 through 137 in the second and third embodiments (refer to FIG. 6 and FIG. 8). FIG. 10 shows an example which employs either the p-channel TFT or the n-channel TFT. In this case, in comparison with the first embodiment, the structure in case of using either the p-channel TFT or the n-channel TFT is less complex than the transmission gates shown in FIG. 7 and does not require a power supply. The number of the required elements can be reduced to a half of the transmission gates, so that the layout area for the data line driving circuit 101 and the scanning line driving circuit 104 can be further reduced, permitting a very small liquid crystal device to be achieved.

Moreover, a bidirectional shift register which has an odd number of output stages in accordance with the present invention can be constituted by using a variety of semiconductor devices, basic circuits, etc., and since an odd number of output stages is used, it is possible to constitute a convenient bidirectional shift register, which allows the transfer direction to be inverted merely by changing the binary level of the transfer direction control signals without the need for inverting the clock signals or the waveform select signals as described above. This makes it possible to realize a liquid crystal device which allows vertical scanning or horizontal scanning to be easily inverted horizontally or vertically.

In the embodiments described above, the bidirectional shift register is configured to allow appropriate time intervals between the waveform select signals ENB1 and ENB2 so as to prevent the waveform select signals ENB1 and ENB2, which are respectively issued from adjoining waveform selector circuits, from being superimposed. Even if a shift register does not have the bidirectional constitution, it is effective for preventing ghosts or uneven images that adjusting the pulse width of a clock signal by using the waveform selector circuit having a structure of the embodiments, and making arrangement to avoid the overlap of adjacent waveform select signals.

Figure 17:
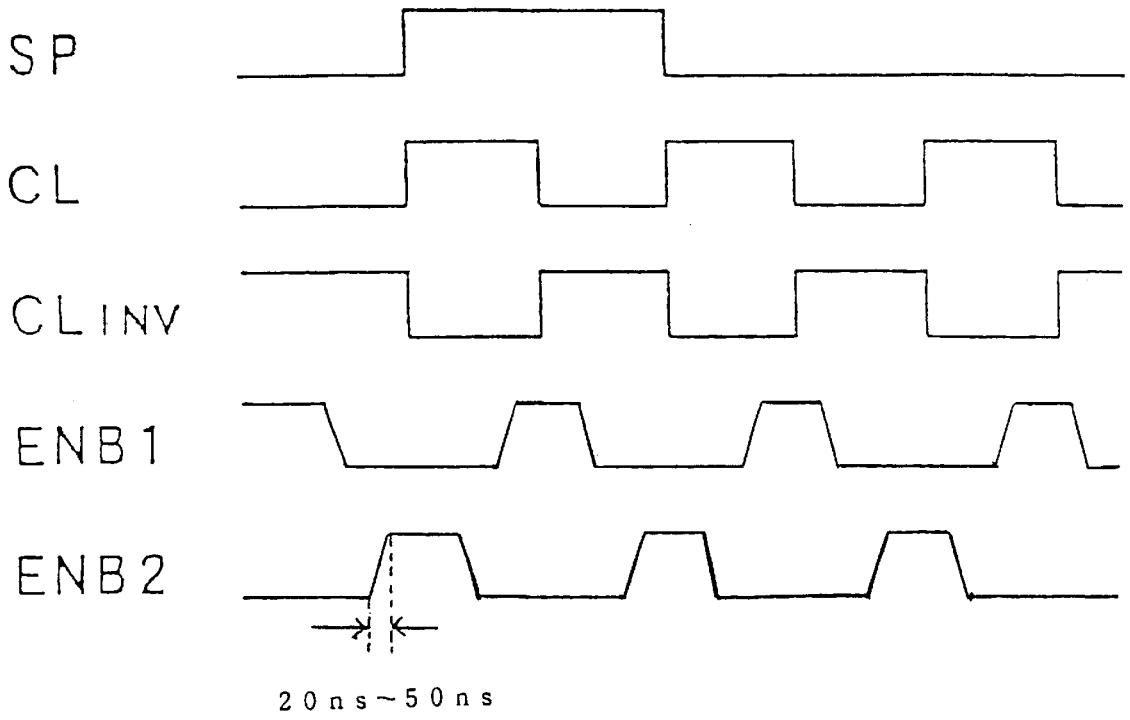
FIG. 17 shows a modification of a waveform select signal of the timing chart in FIG. 3.

A modification of the waveform select signal in the aforesaid embodiments will be described in conjunction with FIG. 17. FIG. 17 illustrates the waveforms of the start signal SP, the clock signal CL and the inverted clock signal CL INV, and the waveform select signals ENB1 and ENB2. Only the differences from the aforesaid embodiments will be described, and the description of common configurations will be omitted.

In FIG. 17, the transition of the pulse waveform of the waveform select signal is not rectangular and is slopped at a few tens of ns, preferably in the range from 20 ns to 50 ns. More specifically, the pulse waveform is not rectangular and is slopped within the foregoing range at the time of rising and falling of the waveform select signals ENB1 and ENB2. By making the pulse waveform non-rectangular in this manner, the ringing of the waveform select signal itself can be suppressed, and it is also possible to prevent the signal components of the waveform select signals from being written as noises into the image signal lines.

Figure 18:
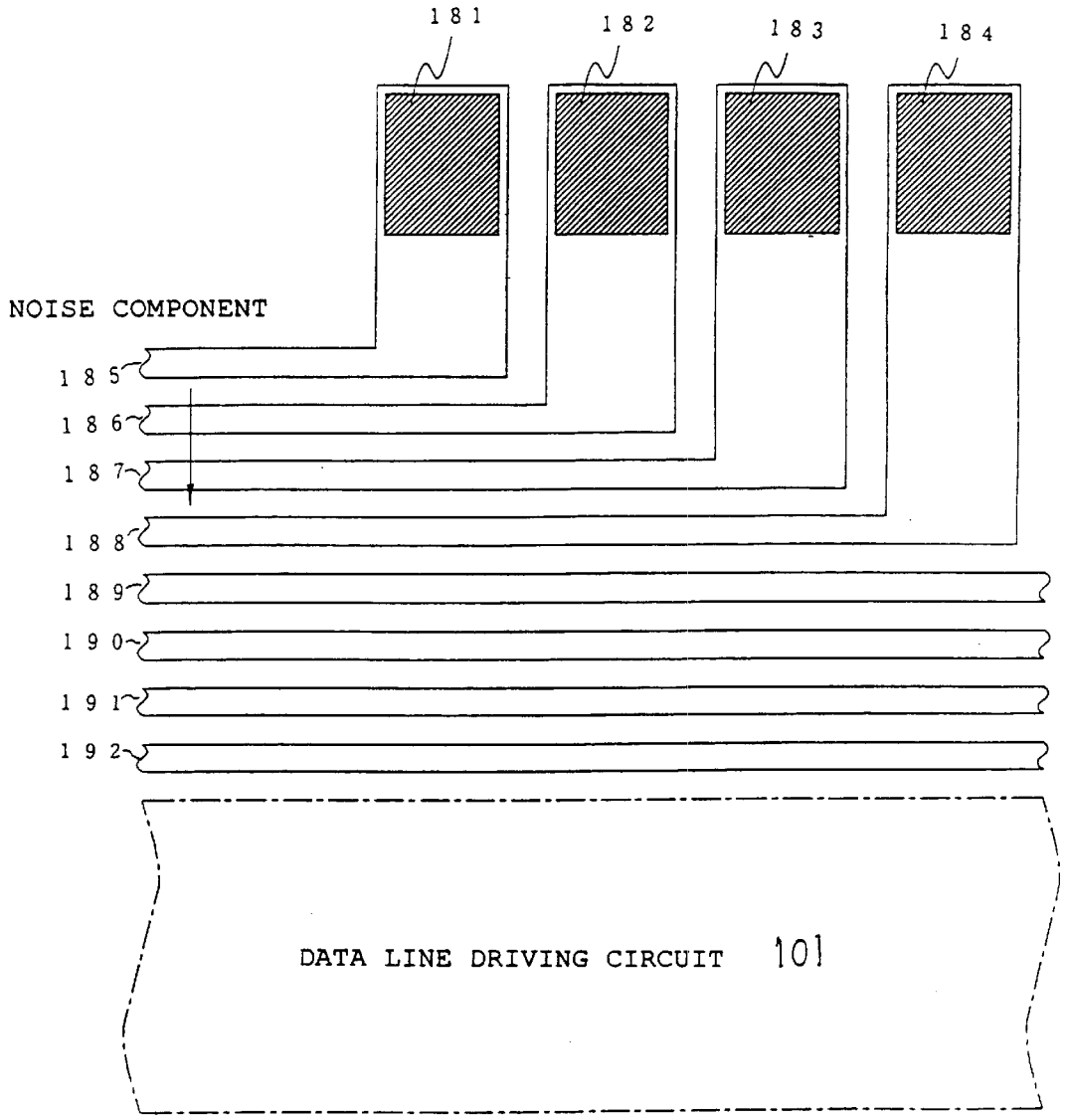
FIG. 18 is a top plan view illustrating an example of the layout of waveform select signal lines and image signal lines.

More description will be given in conjunction with the top plan view of FIG. 18 showing the layout of the waveform select signal and the image signal line. In FIG. 18, reference numerals 185 and 186 denote the waveform select signal lines of the waveform select signals ENB1 and ENB2 and reference numerals 187 through 192 denote the image signal lines VID1 through VID6.

The waveform select signals ENB1 and ENB2 and the image signals VID1 and VID2 are respectively applied from an external circuit (not shown in figure) to the waveform select signal lines 185 and 186 and the image signal lines 187 and 188 via mounted terminals 181, 182, 183, and 184. In the drawing, the mounted terminals of the image signal lines 189 through 192 are omitted.

For instance, as shown in FIG. 18, when the waveform select signal lines 185 and 186 of the waveform select signals ENB1 and ENB2, and the image signal lines 187 through 192 of the image signals VID1 through VID6 are disposed adjacently, it is possible that the waveform select signals ENB1 and ENB2 of the waveform select signal lines 185 and 186 are superimposed as noises on the image signals VID1 through VID6 of the image signal lines 187 through 192. Even if the lines are disposed adjacently, however, such a problem can be avoided by making the transition of the waveform select signals non-rectangular as described above.

In the embodiments given above, an example of the pixel driving means for actively driving the liquid crystal section corresponding to pixels, through the pixel electrode 11 and the TFT 30, has been constituted. The pixel driving means, however, is not limited to the example. For instance, another example of the pixel driving means may be configured by the opposite electrode mentioned below, the pixel electrode 11, and two-terminal nonlinear device, according to the method as follows: one of the data line 35 or the scanning line 31 is provided as an opposite electrode on an opposite substrate, and a two-terminal nonlinear device such as an MIM driving device, which has bidirectional diode characteristics, is installed between the other of the data line 35 and the scanning line 31 formed on the TFT array substrate 1. Further, the embodiment can be applied to a variety of switching devices and also to a variety of liquid crystal materials (liquid crystalline phases), operation modes, liquid crystalline orientation, driving methods, etc.

The embodiments of the electronic apparatus provided with the liquid crystal device 10 which has been explained in detail above will now be described with reference to FIG. 11 through FIG. 15.

Figure 11:
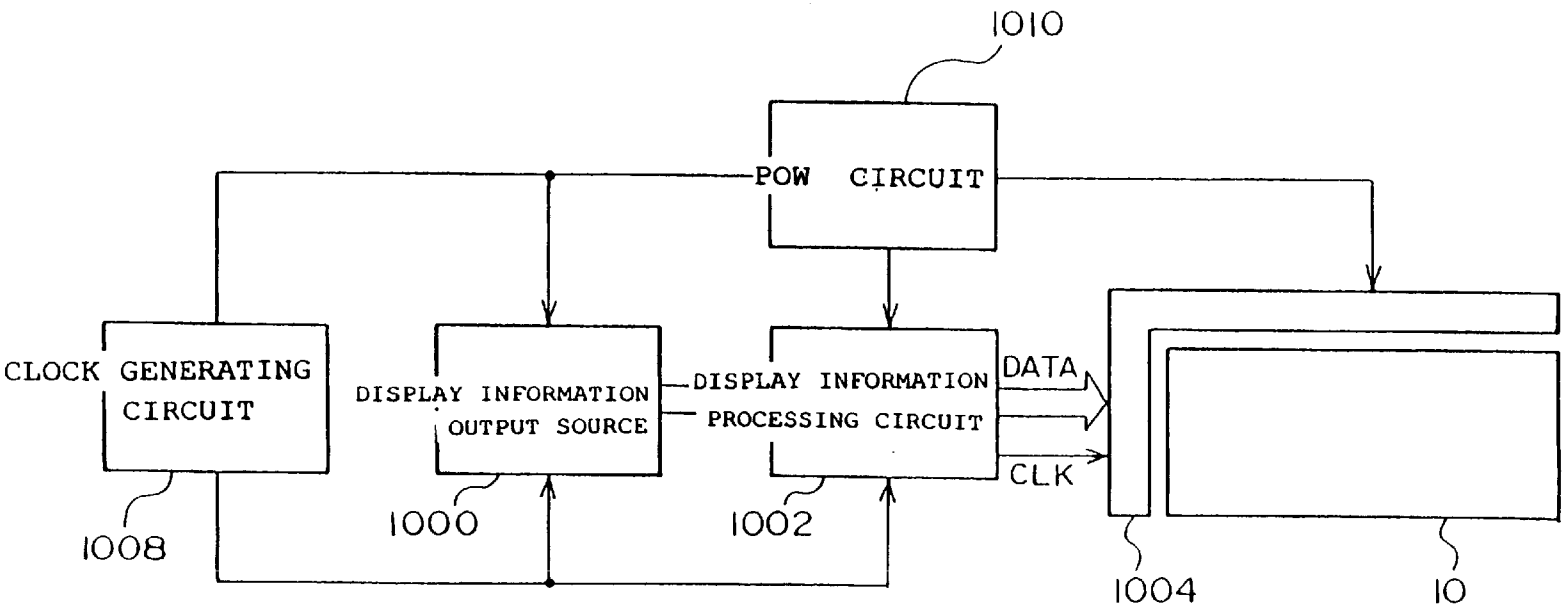
FIG. 11 is a block diagram showing the schematic constitution of an embodiment of the electronic apparatus in accordance with the present invention.

First, FIG. 11 shows the schematic constitution of the electronic apparatus provided with the liquid crystal device 10. In FIG. 11, the electronic apparatus is provided with a display information output source 1000, a display information processing circuit 1002, a driving circuit 1004 which includes the foregoing scanning line driving circuit 104 and the data line driving circuit 101, the liquid crystal device 10, a clock generating circuit 1008, and a power circuit 1010. The display information output source 1000 includes primarily memories such as a read only memory (ROM), a random access memory (RAM), and an optical disk device, and a tuning circuit. It issues display information such as the image signals in a predetermined format to the display information processing circuit 1002 in accordance with the clock signals received from the clock generating circuit 1008. The display information processing circuit 1002 includes widely known various processing circuits such as an amplifier/polarity inverting circuit, a phase developing circuit, a rotation circuit, gamma correcting circuit, and clamping circuit. It sequentially generates digital signals from the display information supplied according to the clock signals and outputs them together with clock signals CLK to the driving circuit 1004. The driving circuit 1004 drives the liquid crystal device 10 according to the driving method described above. The power circuit 1010 supplies predetermined power to the aforesaid circuits. The driving circuit 1004 may alternatively be placed on the TFT array substrate constituting the liquid crystal device 10, in addition, the display information processing circuit 1002 may be mounted thereto.

Specific examples of the electronic apparatus configured as described above are shown in FIG. 12 through FIG. 15.

Figure 12:
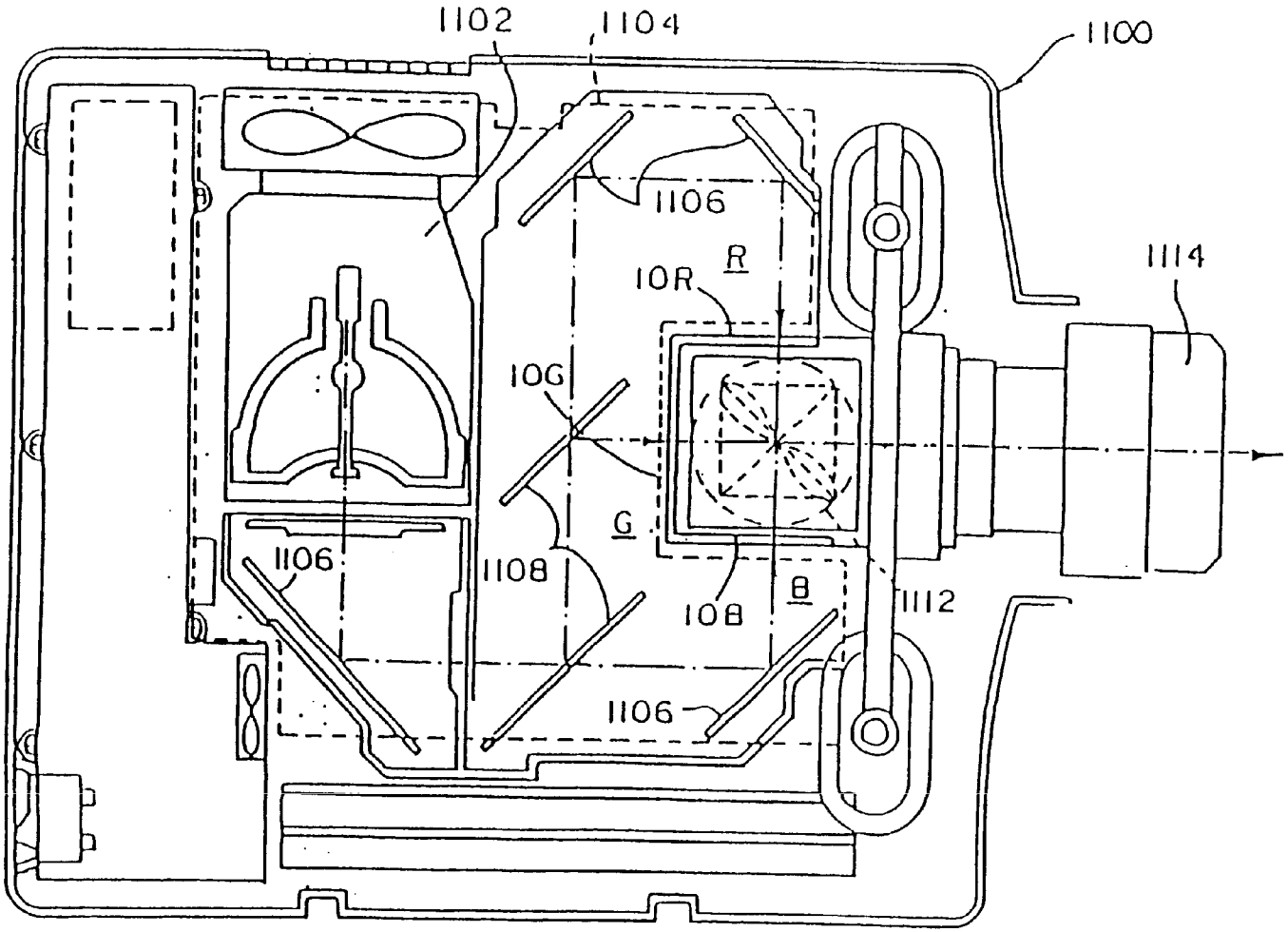
FIG. 12 is sectional view showing a liquid crystal projector as an example of the electronic apparatus.

In FIG. 12, a liquid crystal projector 1100, as an example of an electronic apparatus, has three liquid crystal display modules including the liquid crystal device 10, in which the foregoing driving circuit 1004 is mounted on the TFT array substrate, and the three crystal display modules serving as RGB light valves 10R, 10G, and 10B, respectively, to constitute a projection type projector. In the liquid crystal projector 1100, when an incident light ray is emitted from a lamp unit 1102 serving as a white light source, in a light guide 1104, the light ray is divided into light components R, G, and B corresponding to the RGB three primary colors through two dichroic mirrors 1108 via a plurality of mirrors 1106, and the light components are led to light valves 10R, 10G, and 10B which correspond to the colors. Then, the light components corresponding to the three primary colors, which have been respectively modulated by the light valves 10R, 10G, and 10B, are re-composited through a dichroic prism 1112 before they are projected as a color image onto a screen or the like via a projection lens 1114.

Figure 13:
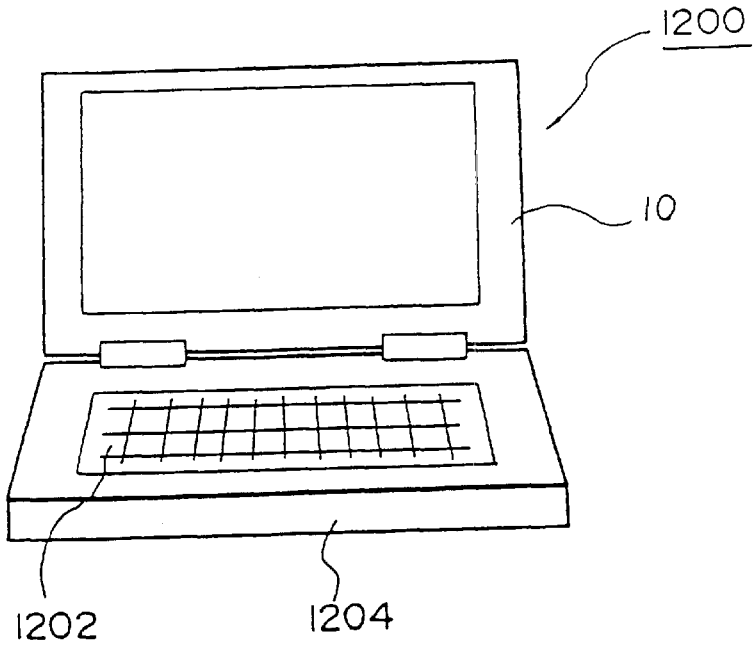
FIG. 13 is a front view illustrating a personal computer as another example of the electronic apparatus.

In FIG. 13, a laptop type personal computer 1200, which is another example of an electronic apparatus, has the aforesaid liquid crystal device 10 provided in the top cover case thereof. It is further provided with a main body 1204 which includes a CPU, memory, modem, etc. and a keyboard 1202.

Figure 14:
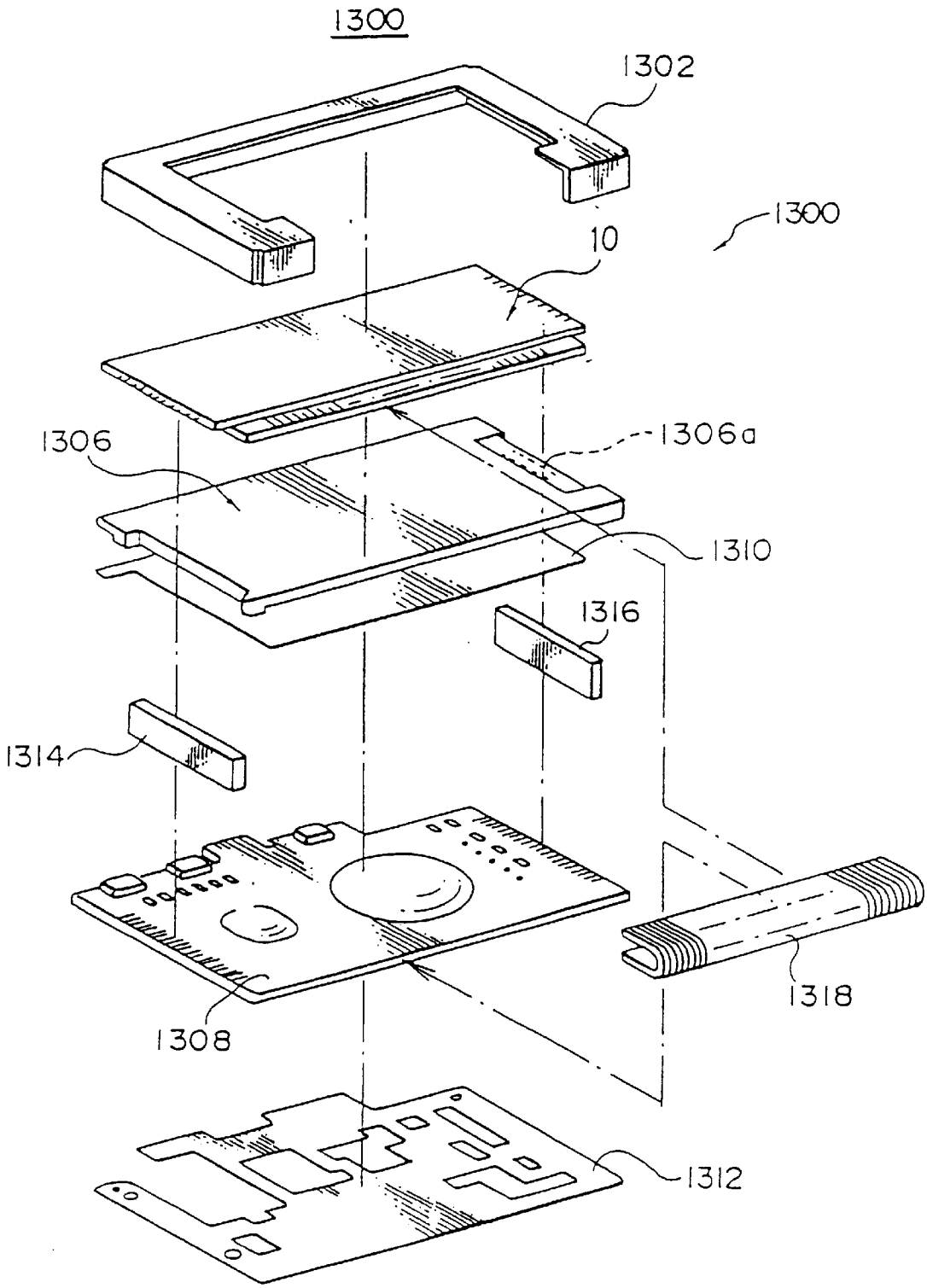
FIG. 14 is an exploded perspective view of a pager as still another example of the electronic apparatus.

FIG. 14 shows a pager 1300, which is a further example of an electronic apparatus. It includes the foregoing driving circuit 1004, which is mounted with a metal frame 1302 on the TFT array substrate, and the liquid crystal device 10, which is to constitute a liquid crystal display module, is also included in the pager 1300 together with a light guide 1306 including a backlight 1306*a*, a circuit board 1308, first and second shielding plates 1310 and 1312, two elastic conductive members 1314 and 1316, and a filter carrier tape 1318. In this example, the foregoing display information processing circuit 1002 (refer to FIG. 11) may alternatively be mounted on the circuit board 1308 or on the TFT array substrate of the liquid crystal device 10. Furthermore, the aforesaid driving circuit 1004 may alternatively be mounted on the circuit board 1308.

Since the example shown in FIG. 14 is a pager, the circuit board 1308 and others are provided, however, in the case of the liquid crystal device 10 wherein the driving circuit 1004 and the display information processing circuit 1002 are mounted to comprise the liquid crystal display module, it is possible to fablicate, sell and use the liquid crystal devices that the liquid crystal device, in which the liquid crystal device 10 is fixed in the metal frame 1302, or the back light type liquid crystal device, in which the light guide 1306 is further provided thereto.

Figure 15:
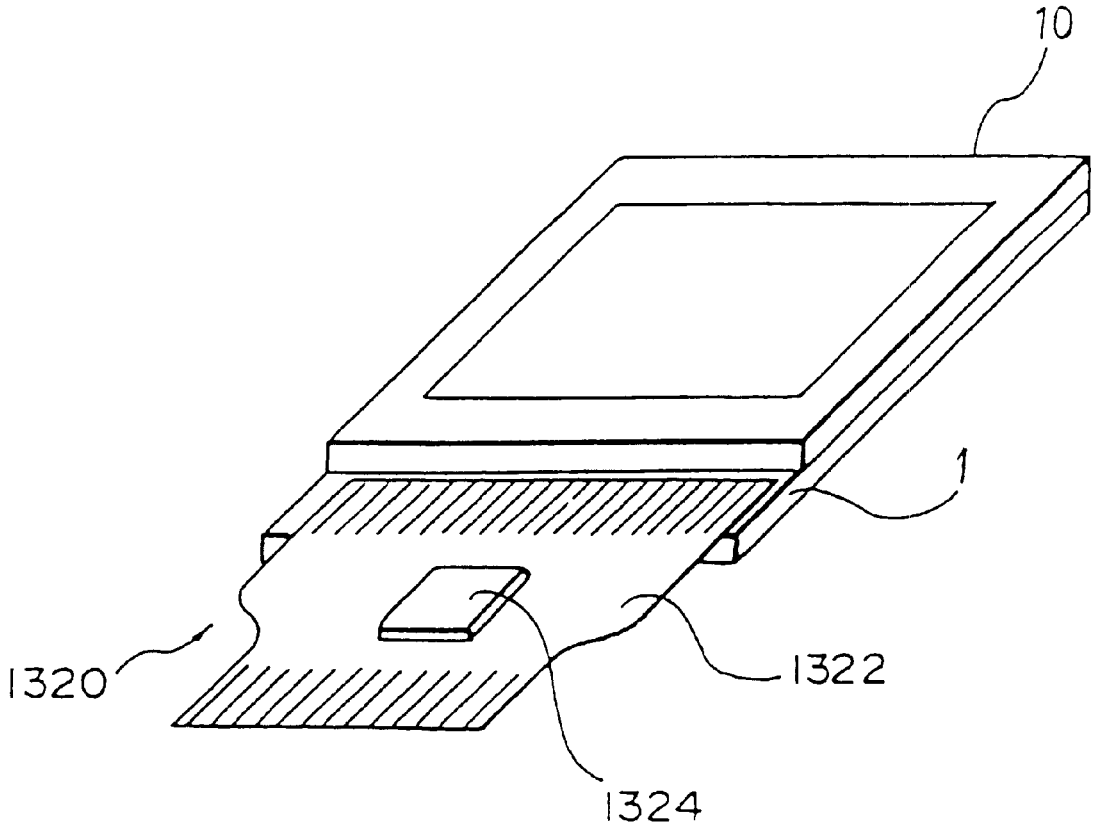
FIG. 15 is a perspective view illustrating a liquid crystal device employing TCP as an example of the electronic apparatus.
Figure 16:
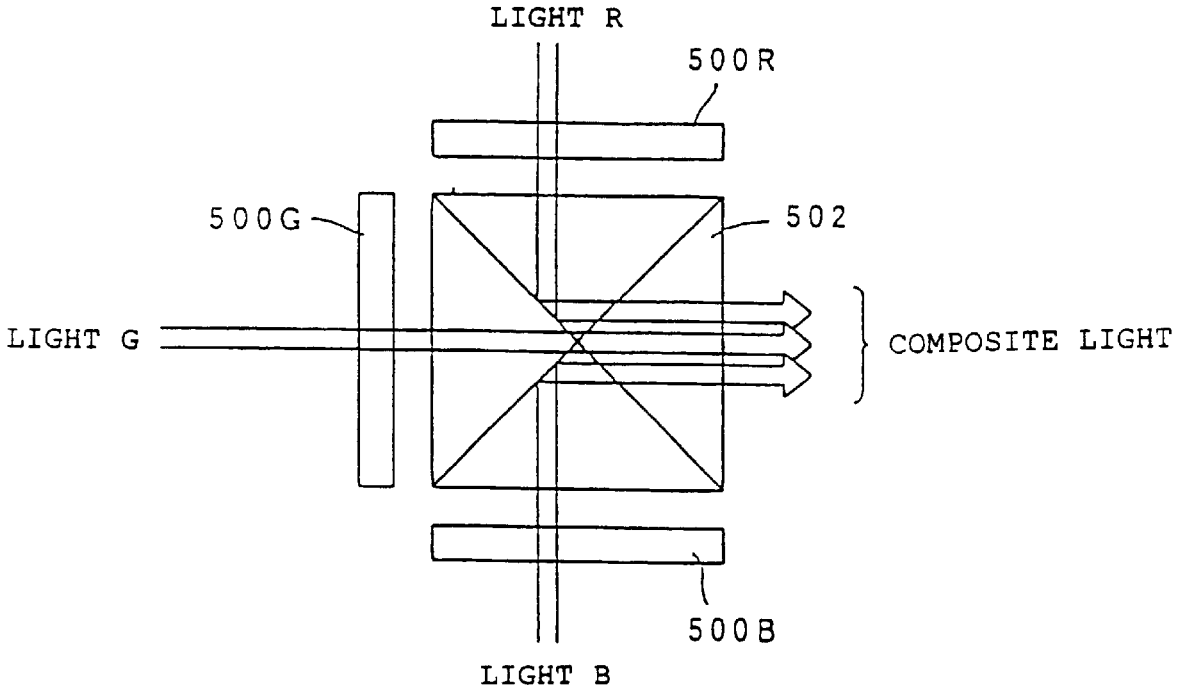
FIG. 16 is a conceptual diagram showing a prism optical system for compounding the three color lights of RGB of the liquid crystal projector.

Further, in case of the liquid crystal device 10, which is not provided with the driving circuit 1004 or the display information processing circuit 1002 as shown in FIG. 15, it is possible to form the liquid crystal device in the following ways, for fablicating, selling and using, that an IC 1324 which includes the driving circuit 1004 and the display information processing circuit 1002 may be physically and electrically connected to a tape carrier package (TCP) 1320, which is mounted on a polyimide tape 1322, via an anisotropic conductive film which is provided around the TFT array substrate 1.

In addition to the electronic apparatus which has been described with reference to FIG. 12 through FIG. 15, there are more examples of the electronic apparatus as shown in FIG. 11, such as liquid crystal televisions, viewfinder type or monitor direct viewing type video tape recorders, car navigation system, electronic organizers, calculators, word processors, workstations, portable telephones, visual telephones, POS terminals, and apparatuses with a touch panel.

The electro-optical apparatus in accordance with the present invention can be used as the electro-optical device including liquid crystal, light emitting polymer, LEDs, etc., and the pixel driving circuit in accordance with the present invention can be used for a various type of active matrix driving system apparatuses. Moreover, the electronic apparatus in accordance with the present invention is constituted using the electro-optical device or the driving circuit as described above, and it can be used as an electronic apparatus or the like which is capable of providing high-quality image display.

What is claimed is:

1. A driving circuit that sequentially drives a plurality of switching elements for use in applying a plurality of image signals to a plurality of pixel electrodes connected to a scanning line used to activate the pixel electrodes, in response to a start signal that defines a start of the sequential drive of the switching elements, the driving circuit comprising:

a first shift register connected to the switching elements that in sequence provides, responsive to the start signal, the switching elements with a plurality of first output signals that serve to in sequence drive the switching elements in a first direction parallel with an arrangement of the pixel electrodes, the first shift register including a plurality of first output circuits that are connected in series to each other, are in sequence connected to the switching elements in the first direction, and each outputs to a succeeding first output circuit a first output signal in response to a first output signal outputted by a previous first output circuit;

a second shift register connected to the switching elements that in sequence provides, responsive to the start signal, the switching elements with a plurality of second output signals used for in sequence driving the switching elements in a second direction inverse to the first direction, the second shift register including a plurality of second output circuits that are connected in series to each other, are in sequence connected to the switching elements in the second direction, and each outputs to a succeeding second output circuit a second output signal in response to a second output signal outputted by a previous second output circuit; and a plurality of selecting circuits that provides the switching elements with a plurality of driving signals that drive the switching elements based upon the first and the second output signals, an Nth first output signal and a (M+1−N) second output signal being outputted to an Nth selecting circuit, M denoting the number of the first output signals, the number of the second output signals, and the number of the selecting circuits, and N denoting an arbitrary number less than or equal to M, wherein in response to a control signal that defines a direction in which the switching elements should be driven in sequence, one of the first shift register and the second shift register in sequence provides the switching elements with ones of the first output signals and the second output signals in one direction of the first direction and the second direction specified by the control signal, ones of the first output circuits and the second output circuits in sequence output the ones of the first output signals and the second output signals to the switching elements in the one direction according to the control signal, the selecting circuits output the driving signals to the switching elements according to a plurality of enable signals that define times at which the selecting circuits should output the driving signals thereto, the selecting circuits output the driving signals to the switching elements according to a plurality of enable signals that define times at which the selecting circuits should output the driving signals thereto.

2. A driving circuit as set forth in claim 1, wherein the number of the first output signals, the number of the second output signals, and the number of the selecting circuits are odd, selecting circuits odd-numbered with respect to both the first and second directions output the driving signals according to a first enable signal that permits the odd-numbered selecting circuits to output the driving signals and selecting circuits even-numbered with respect thereto output the driving signals according to a second enable signal that permits the even-numbered selecting circuits to output the driving signals.

3. A driving circuit as set forth in claim 2, wherein the first and second output circuits are inverters.

4. A driving circuit as set forth in claim 3, wherein the first shift register further includes a plurality of first inverters and a plurality of second inverters each laid between two adjacent output circuits, the second shift register further includes a plurality of third inverters and a plurality of fourth inverters each laid between two adjacent output circuits, and the first inverters and the third inverters operate based upon a first clock signal, and the second inverters and the fourth inverters operate based upon a second clock signal inverse in phase to the first clock signal.

5. A driving circuit as set forth in claim 4, wherein the order of the first output circuits, the first inverters, and the second inverters in the first shift register and the order of the second output circuits, the third inverters, and the fourth inverters in the second shift register are similar to each other.

6. A driving circuit as set forth in claim 5, wherein the first inverters and the second inverters in the first shift register are connected to the second shift register and implement a feedback on the second output signals in the second shift register, and the third inverters and the fourth inverters in the second shift register are connected to the first shift register and implement a feedback on the first output signals in the first shift register.

7. A driving circuit as set forth in claim 1, the selecting circuits perform logic AND on the first and second output signals and the first and second enable signals to define a period of time during which the switching elements are being turned on.

* * * * *